US009733591B2

(12) United States Patent
Imaizumi

(10) Patent No.: US 9,733,591 B2
(45) Date of Patent: Aug. 15, 2017

(54) IMAGE FORMING APPARATUS

(71) Applicant: CANON KABUSHIKI KAISHA, Tokyo (JP)

(72) Inventor: Chikara Imaizumi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/054,296

(22) Filed: Feb. 26, 2016

(65) Prior Publication Data

US 2016/0252845 A1 Sep. 1, 2016

(30) Foreign Application Priority Data

Feb. 27, 2015 (JP) ..... 2015-037865
Jan. 21, 2016 (JP) ..... 2016-009781

(51) Int. Cl.
*G03G 21/00* (2006.01)
*G03G 15/08* (2006.01)

(52) U.S. Cl.
CPC ..... *G03G 15/0886* (2013.01); *G03G 15/0877* (2013.01)

(58) Field of Classification Search
None
See application file for complete search history.

(56) References Cited

U.S. PATENT DOCUMENTS

2007/0248384 A1* 10/2007 Kawai ..... G03G 15/0886 399/260
2015/0277298 A1 10/2015 Suzuki et al.

FOREIGN PATENT DOCUMENTS

JP 2001-318570 A 11/2001

* cited by examiner

*Primary Examiner* — David M Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes a first unit including a toner discharge opening; a second unit including a toner receiving opening, wherein at least one of the first unit and the second unit is detachably mountable to the apparatus; and a shutter for permitting toner flow from the first unit into the second unit when the one unit is set in the apparatus, and the toner discharge opening of the first unit is above the toner receiving opening of the second unit, the shutter being effective to close when the one unit is removed from the main assembly. By inserting the first unit or the second unit into the main assembly, the shutter is moved to a position right above the toner receiving opening of the second unit, and thereafter, the shutter is opened by a further insertion of the one unit.

11 Claims, 21 Drawing Sheets

IMAGE FORMING APPARATUS

FIELD OF THE INVENTION AND RELATED ART

The present invention relates to an image forming apparatus for forming a toner image on a sheet.

In an electrophotographic type image forming apparatus such as a printer, a copying machine, a facsimile machine or the like for forming a monochromatic and/or color toner images, a toner image formed on a photosensitive drum or an intermediary transfer belt or the like which is an image bearing member may not be completely transferred onto the sheet but may remain thereon. The untransferred toner remaining on the image bearing member is removed from the image bearing member by a cleaning mechanism and is collected into a toner collection container provided in the main assembly of the apparatus, by a toner feeding mechanism.

When the toner collection container becomes full with the untransferred toner (residual toner), it is replaced with a new empty toner collection container. It is customary to provide a shutter in order to prevent toner scattering which may occur in the connecting portion between the toner feeding mechanism and the toner collection container. This shutter is closed when the toner collection container is removed, and it is opened when the toner collection container is mounted to the main assembly of the apparatus.

A photosensitive drum and a mechanism for a removing the untransferred toner from the photosensitive drum may be unified into a process cartridge which is detachably mountable to the main assembly of the apparatus.

In this type, the untransferred toner remaining on the photosensitive drum is collected into a toner collection container provided in the main assembly of the apparatus.

In the image forming apparatus of this type, a disengageable connecting portion is provided between the process cartridge and the toner feeding mechanism, because the toner feeding mechanism is fixed in the main assembly. Usually, in order to prevent leakage of the untransferred toner upon the disengagement of the connecting portion, there is provided in the process cartridge side with a slidable shutter which is slidable across a remaining toner exit opening to open and close the exit opening.

As a method for opening and closing the shutter provided between the main assembly side toner discharge opening and the toner collection container, the structure including a gear configuration on the shutter and a rack gear on the toner collection container side is known (Japanese Laid-open Patent Application 2001-318570).

With this structure, when the toner collection container is exchanged, the rack gear is engaged with the shutter side gear, and the shutter is opened and closed in interrelation with the rotation of the shutter side gear.

In the conventional structure, the scattering of the untransferred toner over the portion around the main assembly is suppressed by opening and closing the shutter in response to the inserting and removing operations of the toner collection container or the process cartridge relative to the main assembly by the user.

SUMMARY OF THE INVENTION

However, when the toner collection container is moved quickly, the following problem may arise.

Before the shutter portion is closed, the toner collection container side receiving port may be displaced from the main assembly side toner discharge opening, with the result that the untransferred toner deposited on the shutter portion may scatter into the main assembly instead of being received by the toner collection container side receiving port.

In addition, in the image forming apparatus employing the slidable shutter in the connecting portion for transferring the remaining toner from the process cartridge to the toner feeding mechanism, the remaining toner may fall into the main assembly of the apparatus depending on the movement timing of the slidable shutter.

Accordingly, it is an object of the present invention to provide an image forming apparatus in which the toner scattering in the connecting portion upon the mounting and dismounting of the unit which is detachably mountable to the main assembly of the apparatus is reduced.

It is another object of the present invention to provide an image forming apparatus for forming a toner image on a sheet, said image forming apparatus comprising a main assembly; a first unit including a toner discharge opening; a second unit including a toner receiving opening, wherein at least one of said first unit and said second unit is detachably mountable to said main assembly; and a shutter configured to permit toner to move from said first unit into said second unit in a state that said at least one of said first unit and said second unit are set in said main assembly, and said toner discharge opening of said first unit is above said toner receiving opening of said second unit, said shutter being further configured to close said toner discharge opening of said first unit when said at least one of said first unit and said second unit is removed from said main assembly, wherein by inserting said at least one of said first unit and said second unit into said main assembly, said shutter is moved to a position right above said toner receiving opening of said second unit or at least a predetermined part of a sealing member for said toner receiving opening, and thereafter, said shutter is opened by a further insertion of said at least one of said first unit and said second unit.

Further features of the present invention will become apparent from the following description of exemplary embodiments with reference to the attached drawings.

Figure 3:
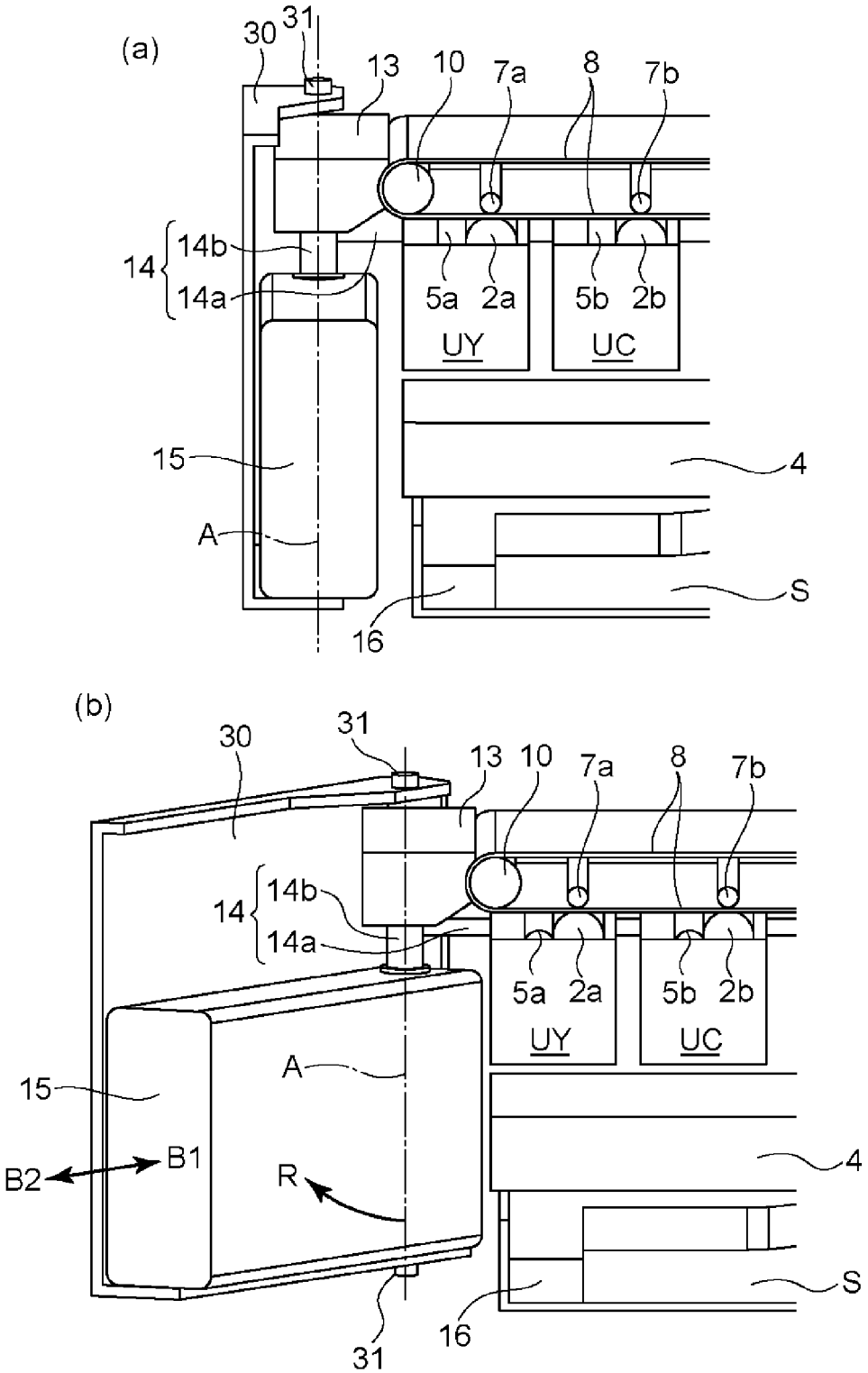

Parts (a) and (b) of FIG. 3 shows a left-hand door and a toner collection container.

Figure 4:
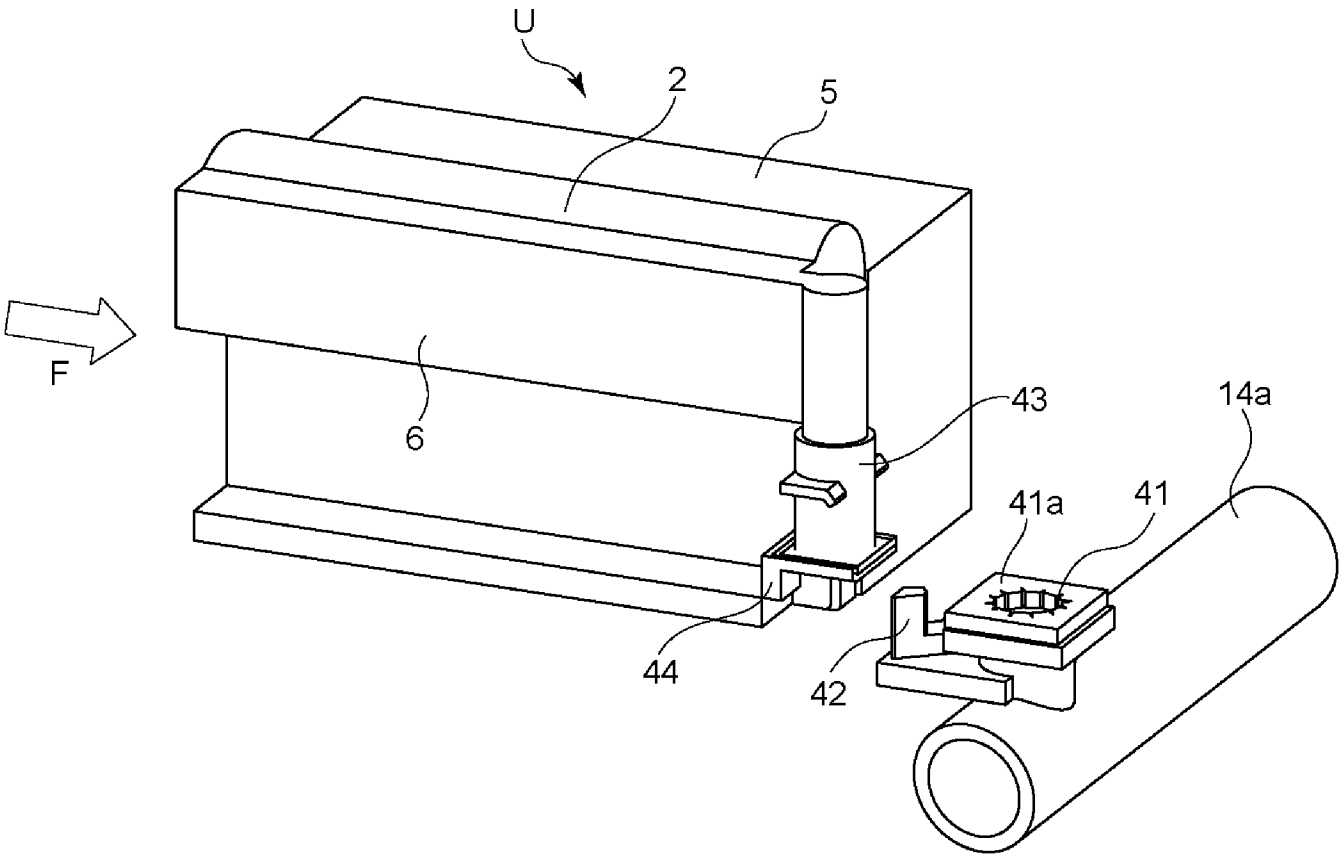

FIG. 4 is a perspective view of the neighborhood of the relaying portion in the process of mounting of the process cartridge to the main assembly of the apparatus.

Figure 5:
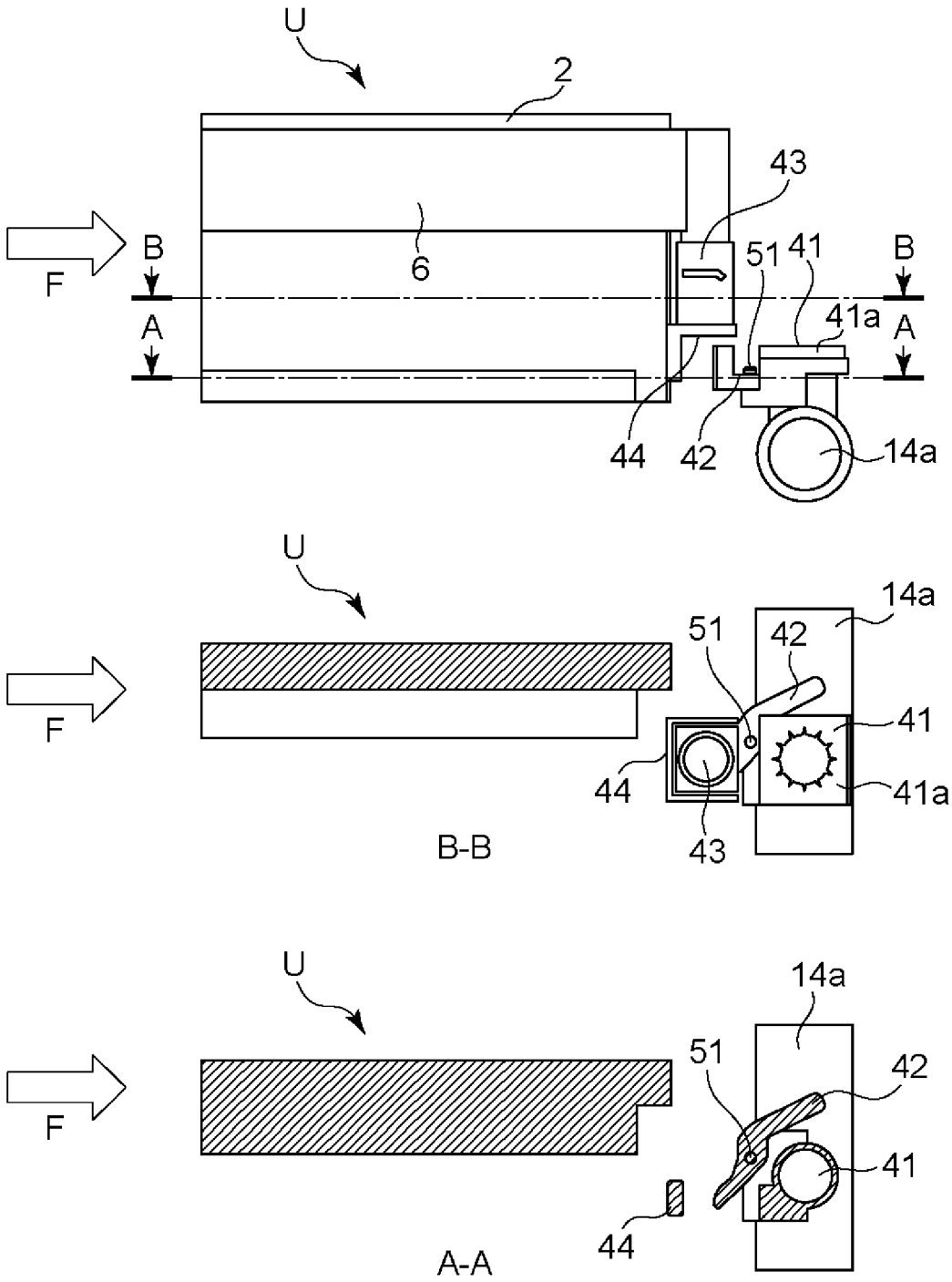

FIG. 5 shows the state before the operation of the shutter.

Figure 6:
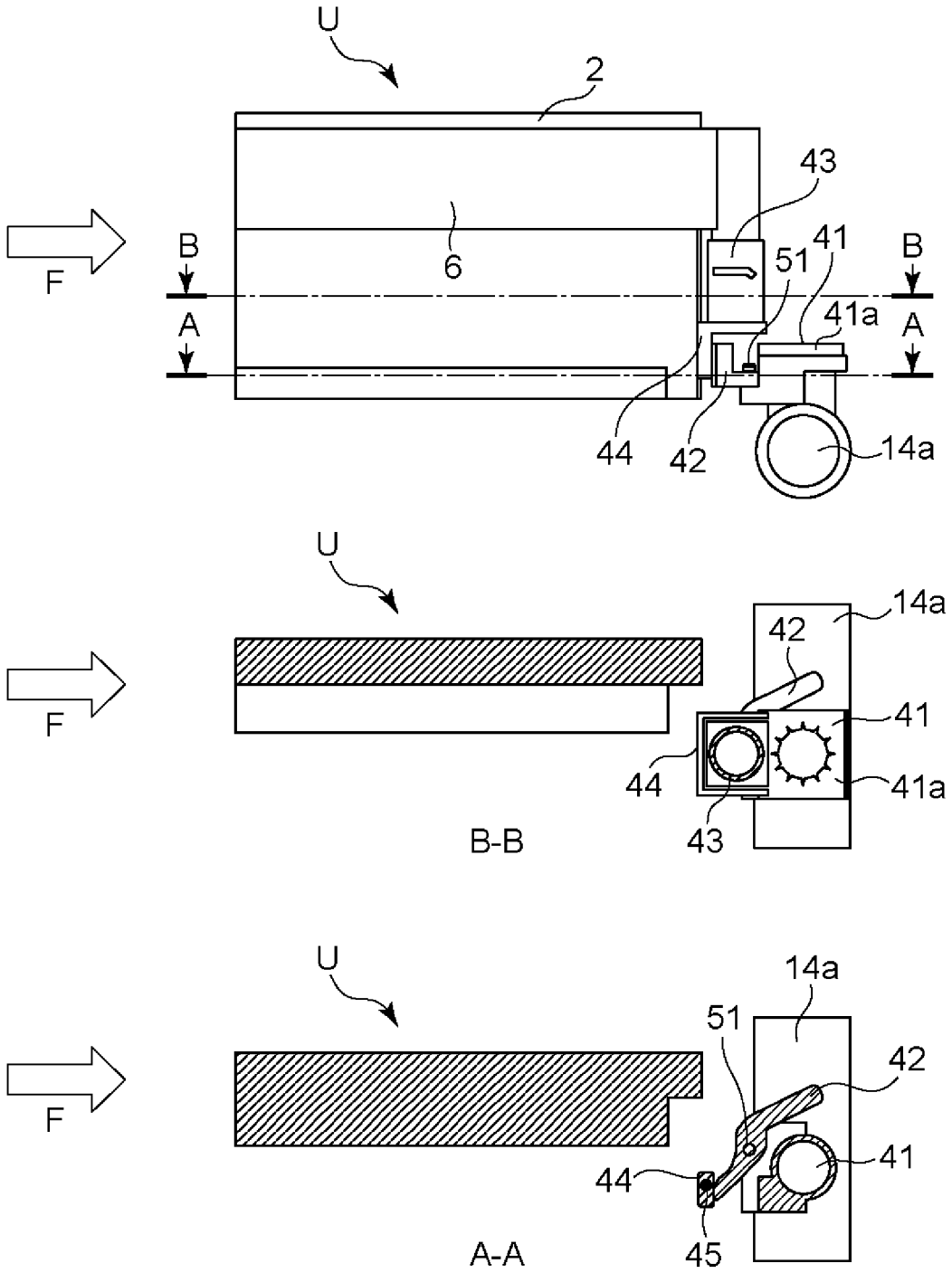

FIG. 6 shows the state at which the shutter starts contacting the shutter opening member.

Figure 7:
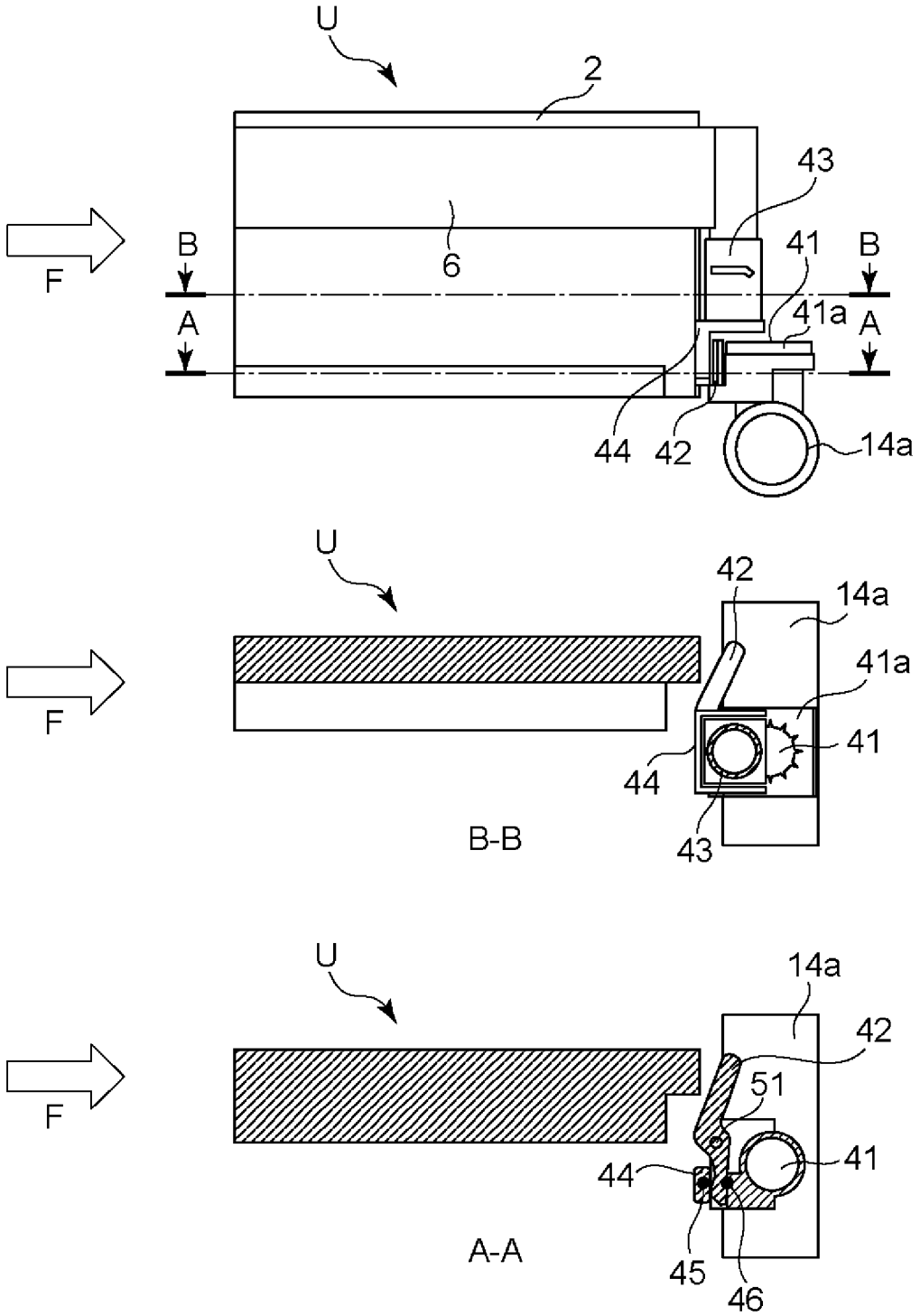

FIG. 7 shows the state in which the shutter opening member contacts the rotation abutting portion.

Figure 8:
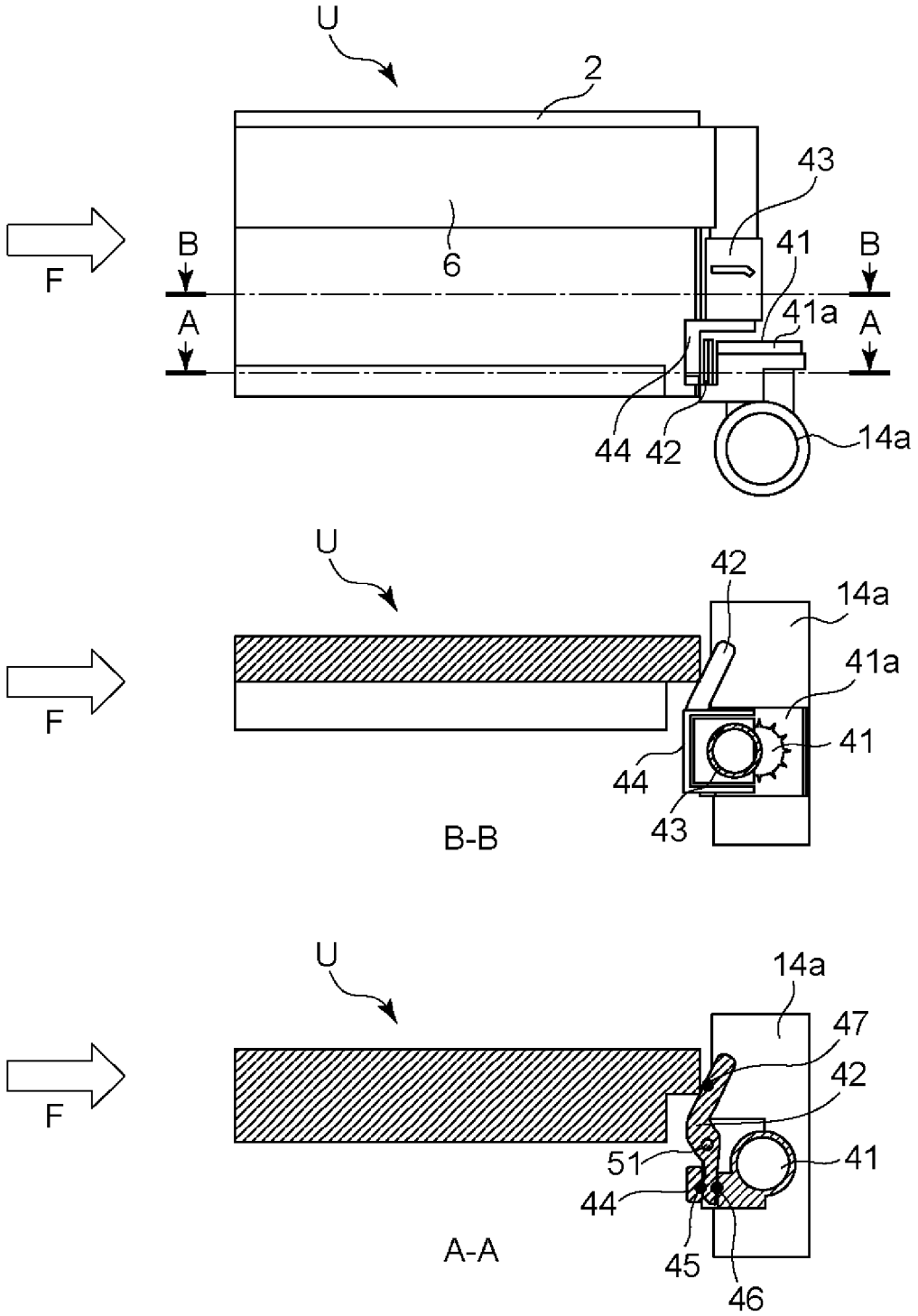

FIG. 8 shows the state in which the process cartridge starts contacting the shutter opening member.

Figure 9:
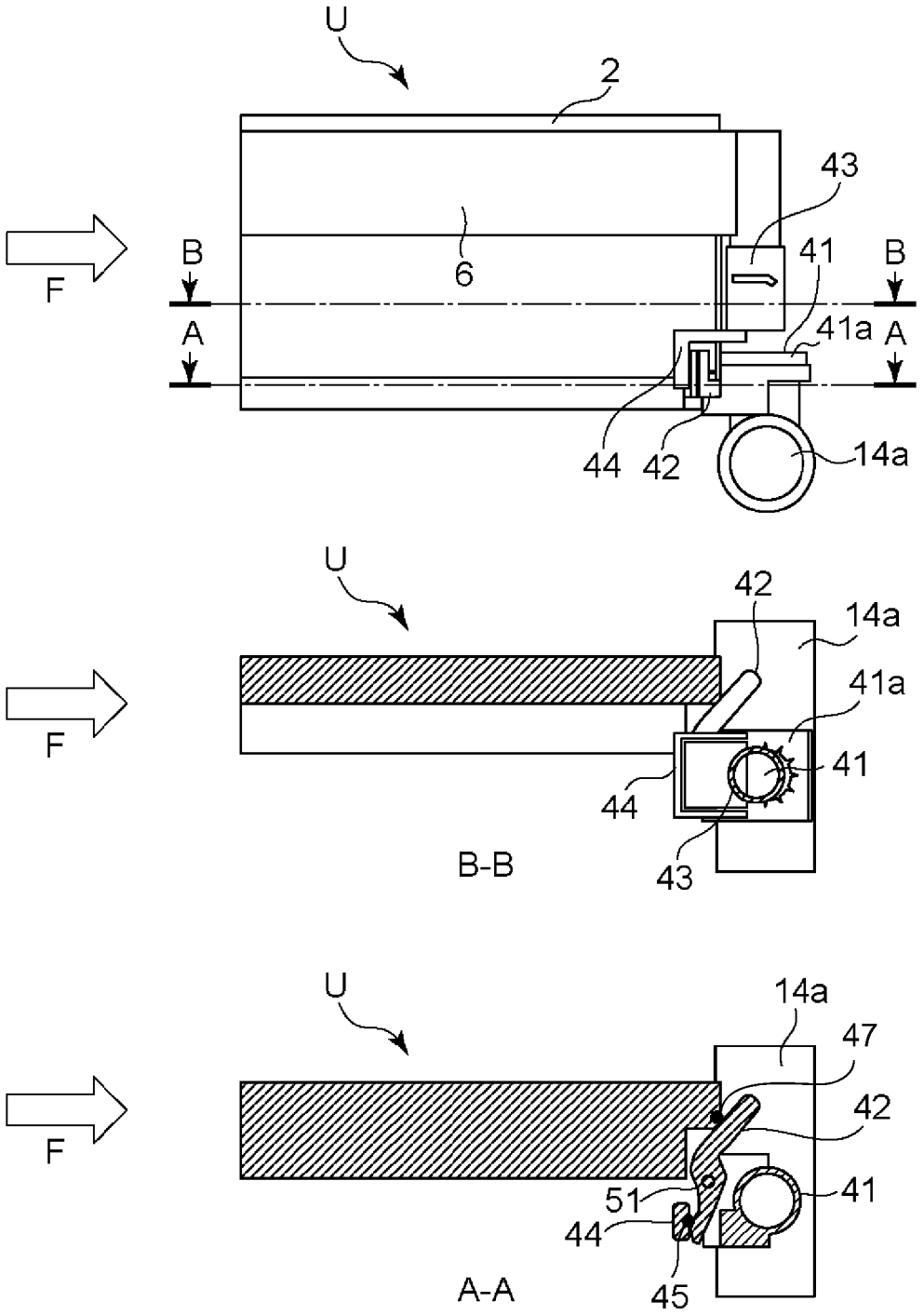

FIG. 9 shows the state in which the shutter opening member rotates in the process cartridge, and the shutter is in the process of opening.

Figure 10:
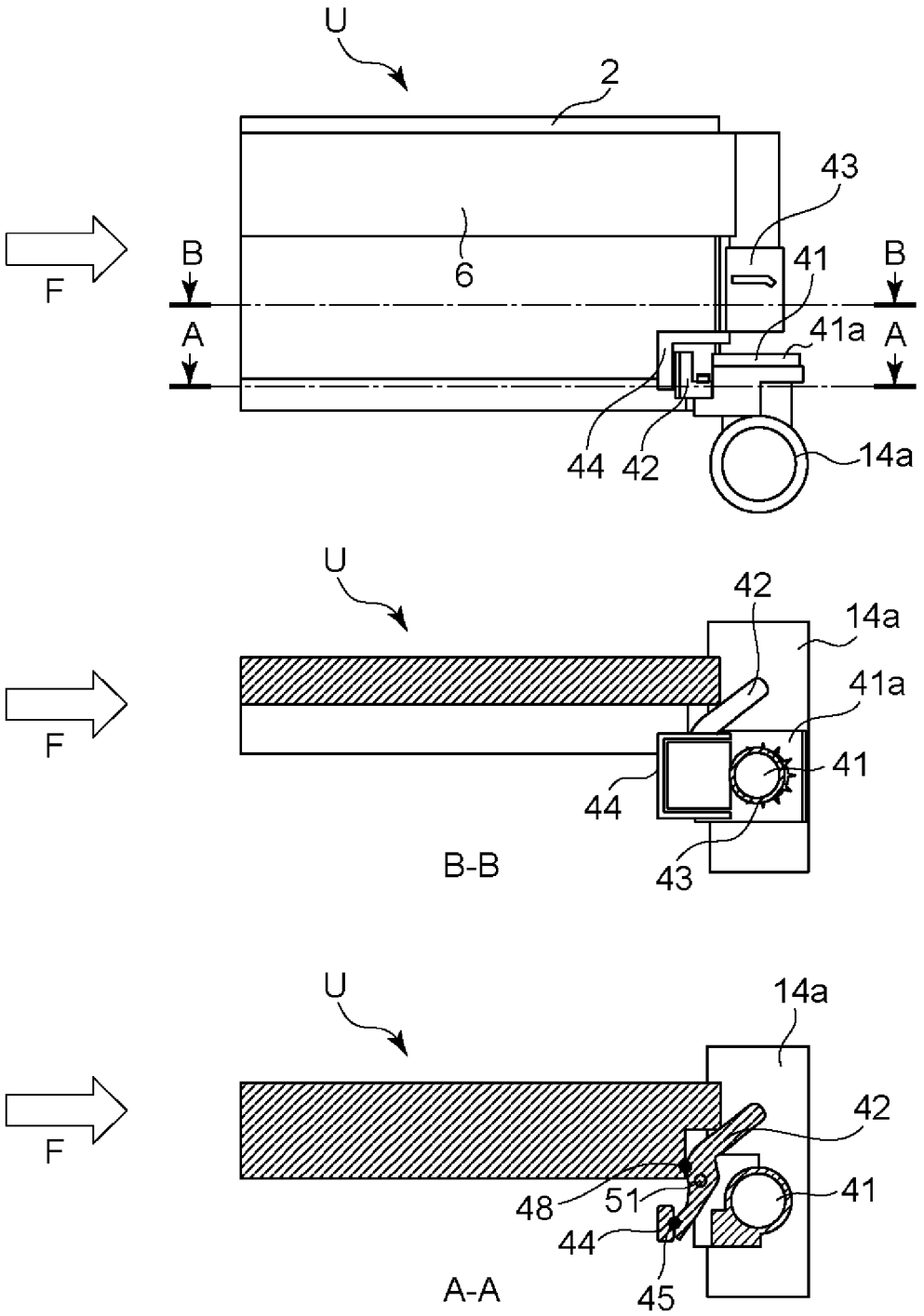

FIG. 10 shows the state that the surface pressing the shutter opening member is moved.

Figure 11:
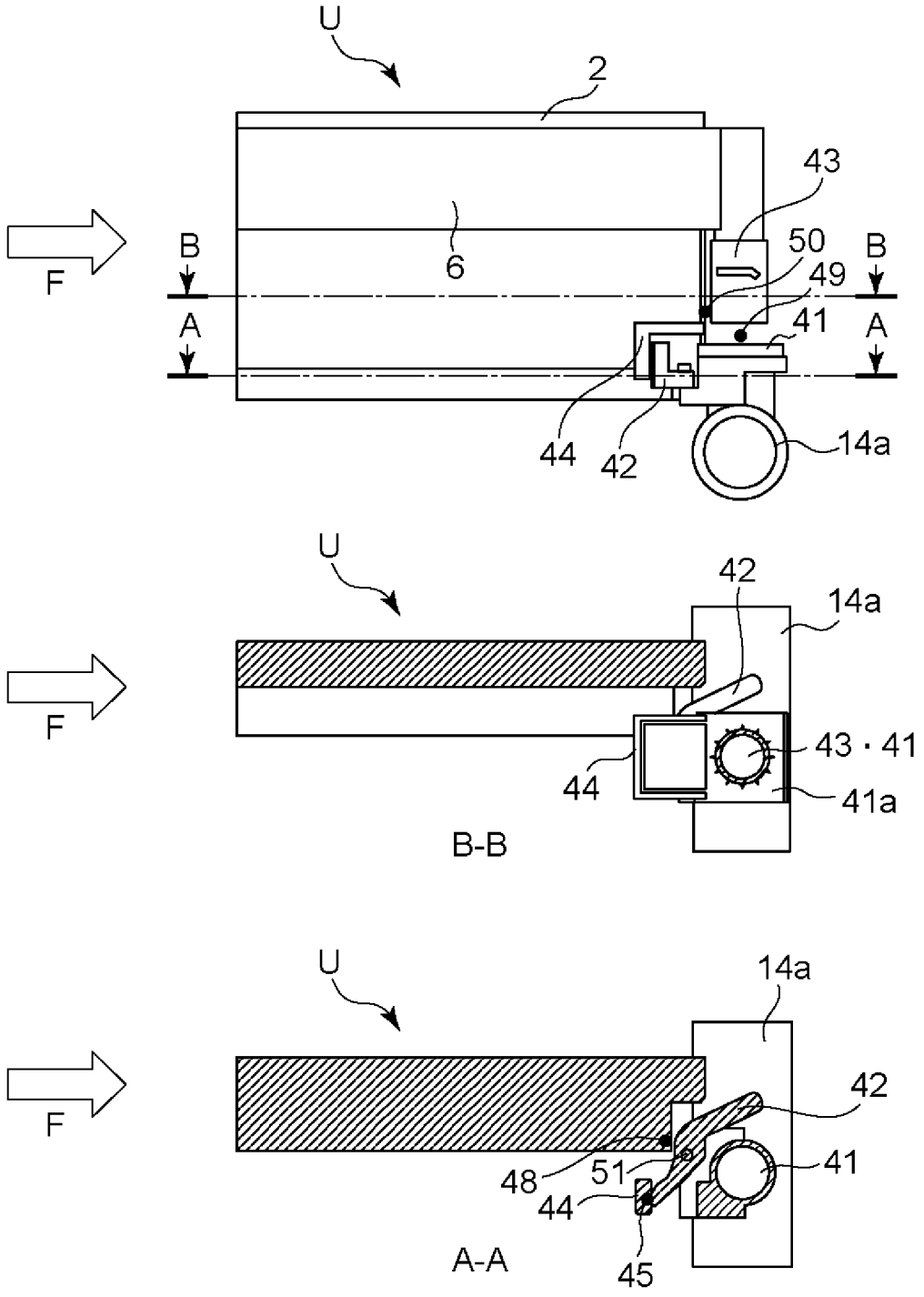

FIG. 11 shows the state in which the process cartridge is completely set in the main assembly of the apparatus.

Figure 12:
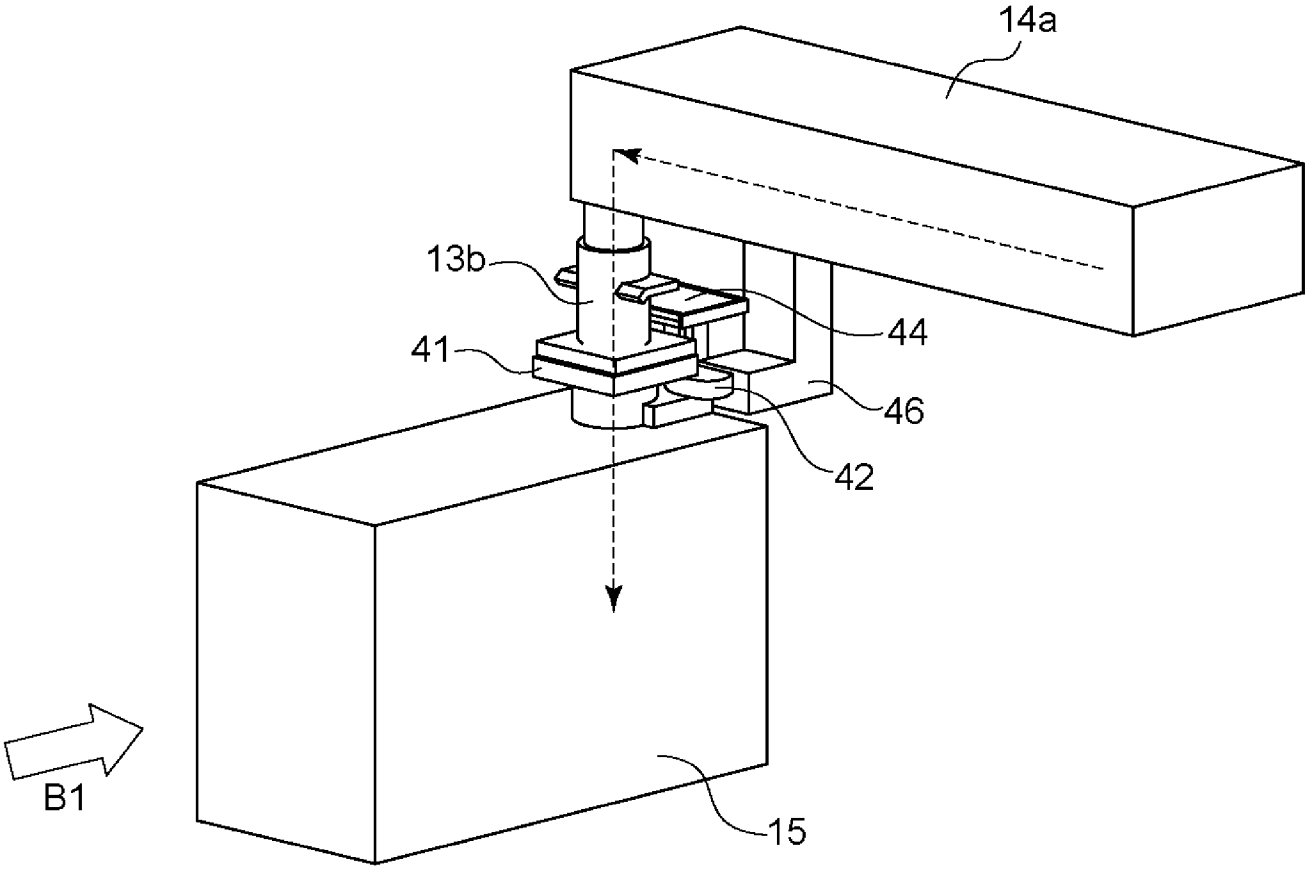

FIG. 12 is a perspective view of a neighborhood of a relaying portion when the image forming operation is carried out with the process cartridge mounted in place, according to Embodiment 2 of the present invention.

Figure 13:
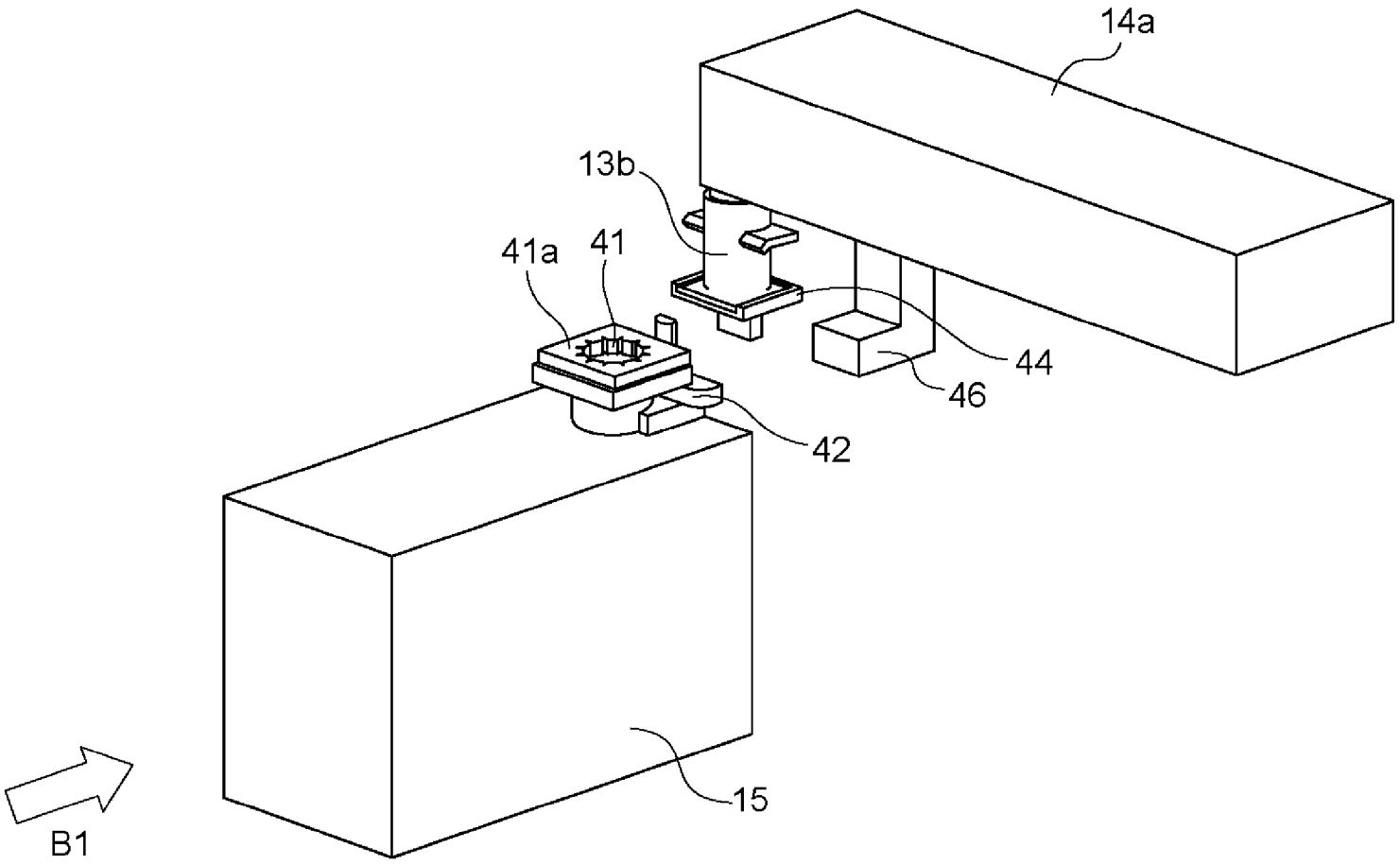

FIG. 13 is a perspective view of the neighborhood of the relaying portion in the process of the toner collection container being mounted to the main assembly.

Figure 14:
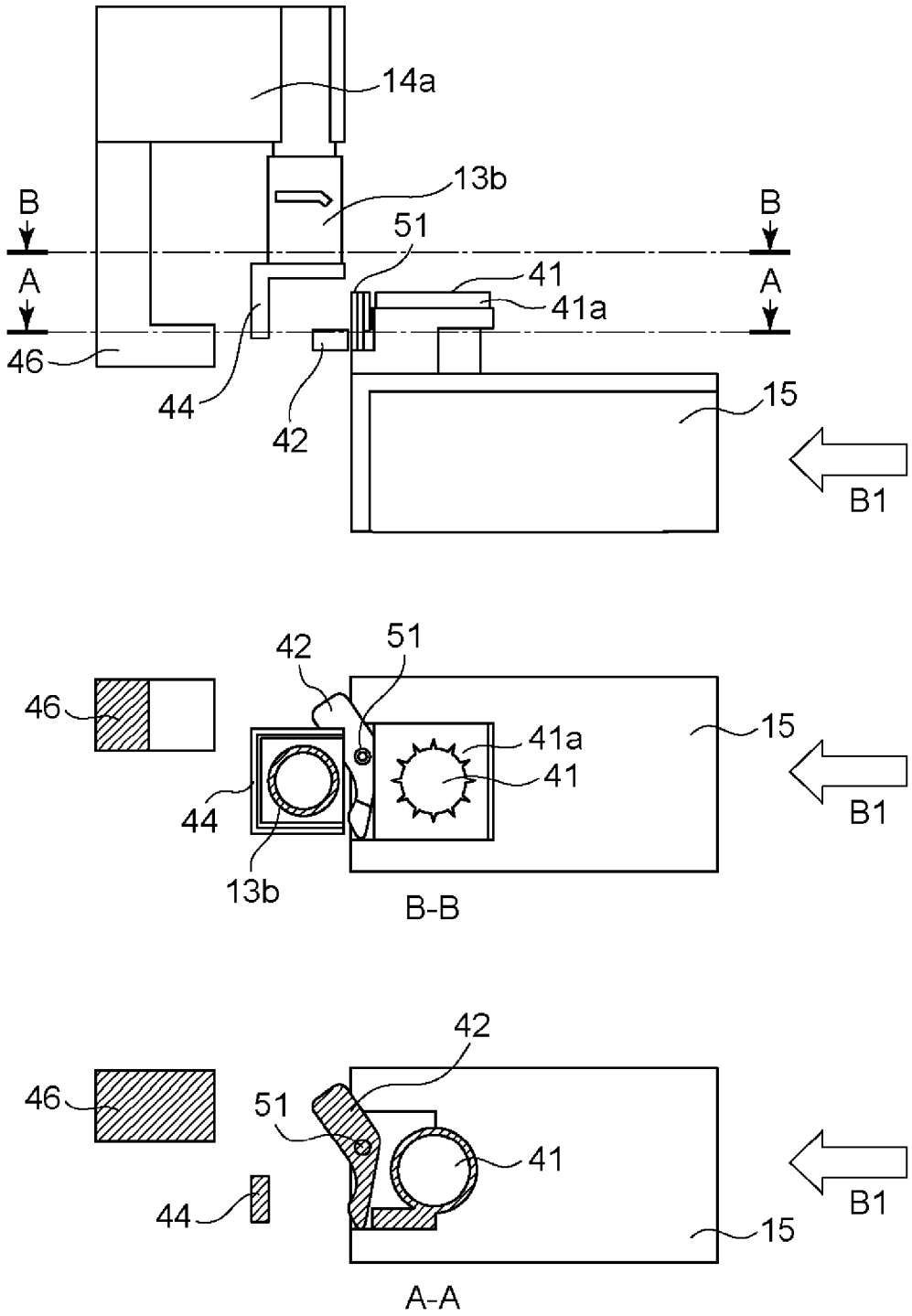

FIG. 14 shows the state before the shutter operation.

Figure 15:
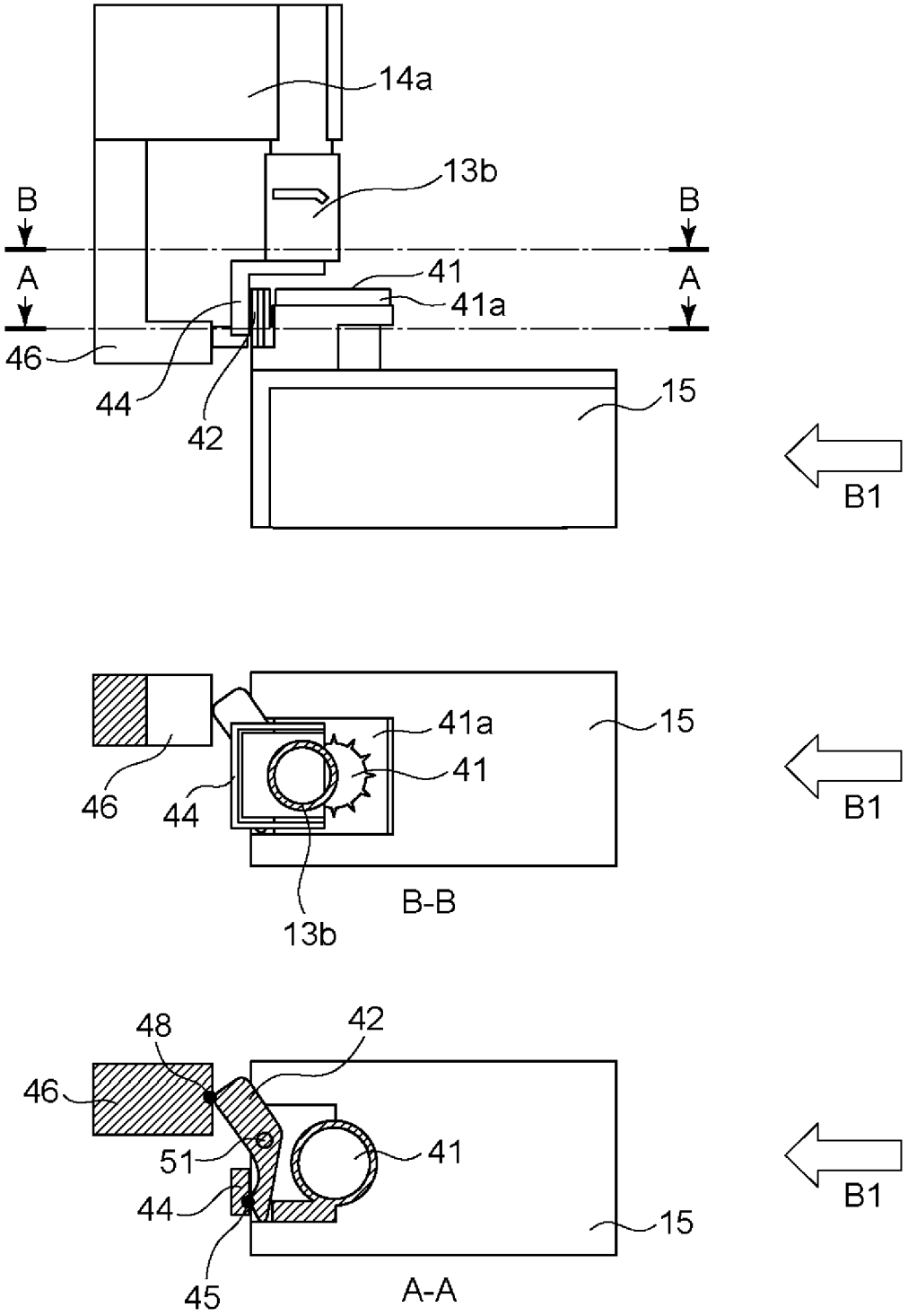

FIG. 15 shows the state in which the shutter opening member is rotating to open the toner shutter.

Figure 16:
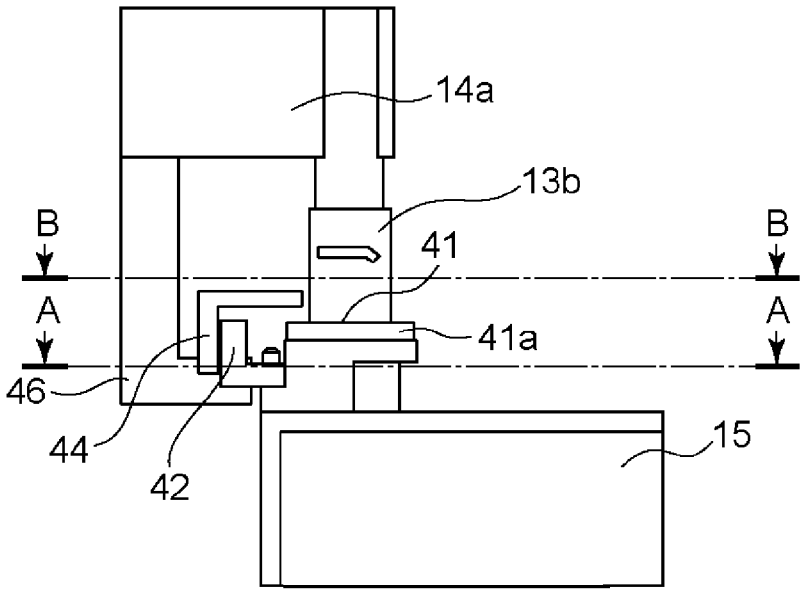
Figure 16:
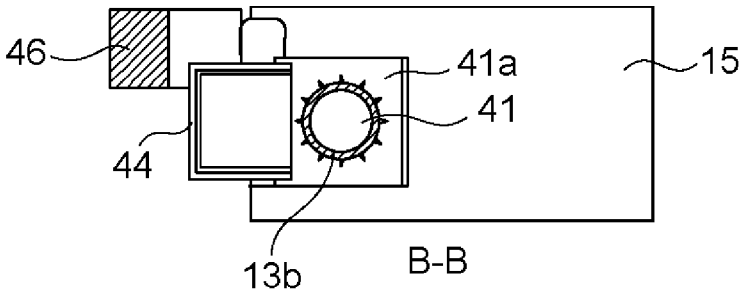
Figure 16:
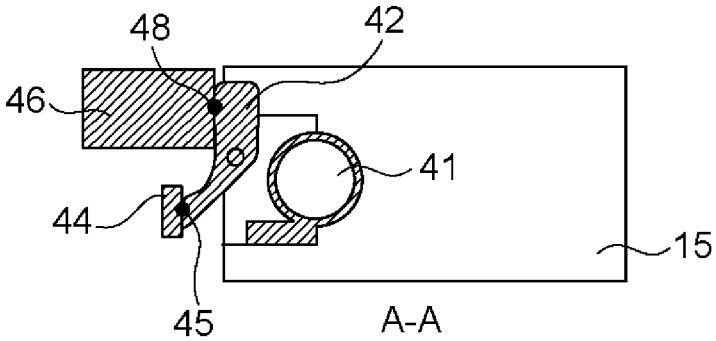

FIG. 16 shows the state in which the toner collection container is mounted to the main assembly, and the door is closed.

Figure 17:
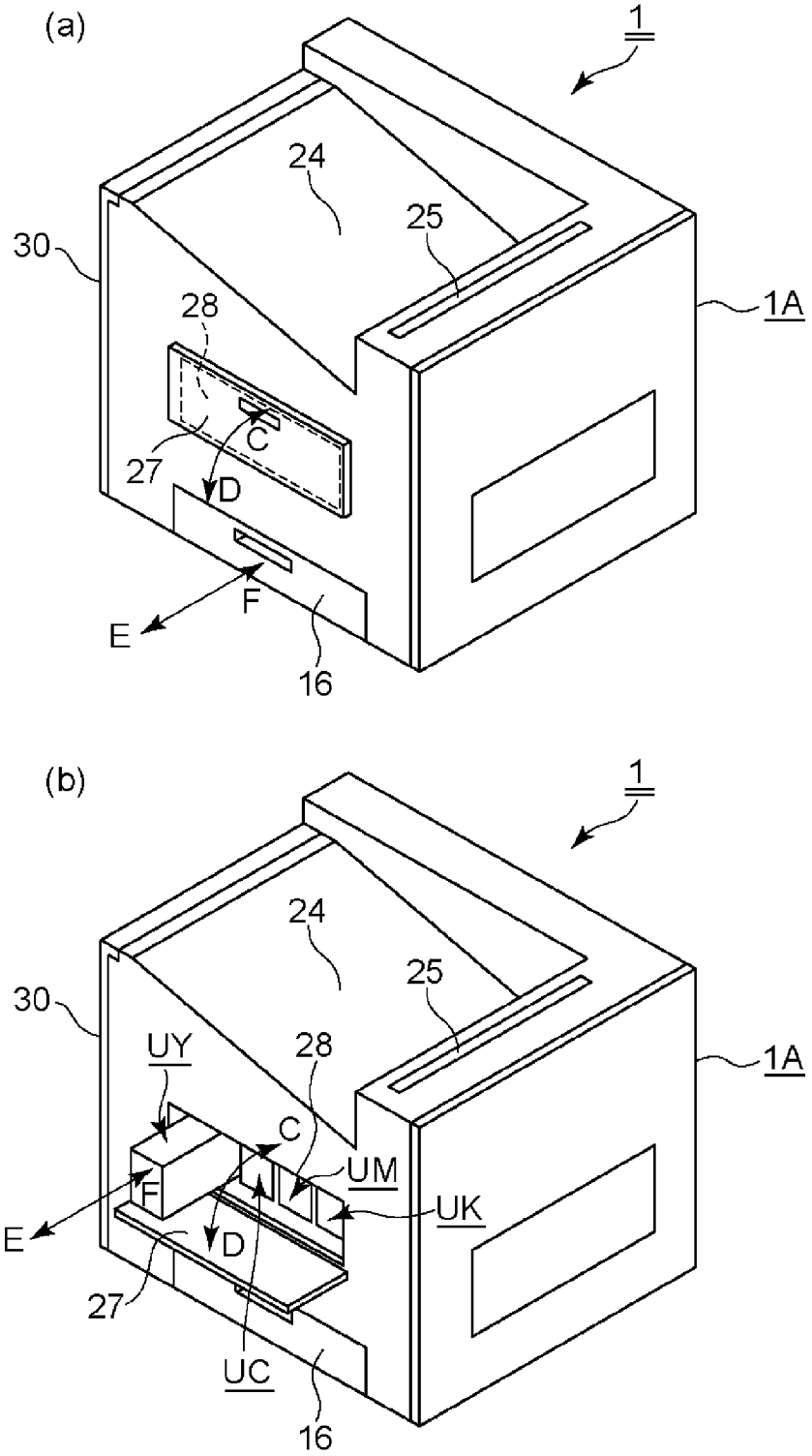

Parts (a) and (b) of FIG. 17 are perspective views of an outer appearance of the image forming apparatus with which the mounting and dismounting of the process cartridge will be described.

Figure 18:
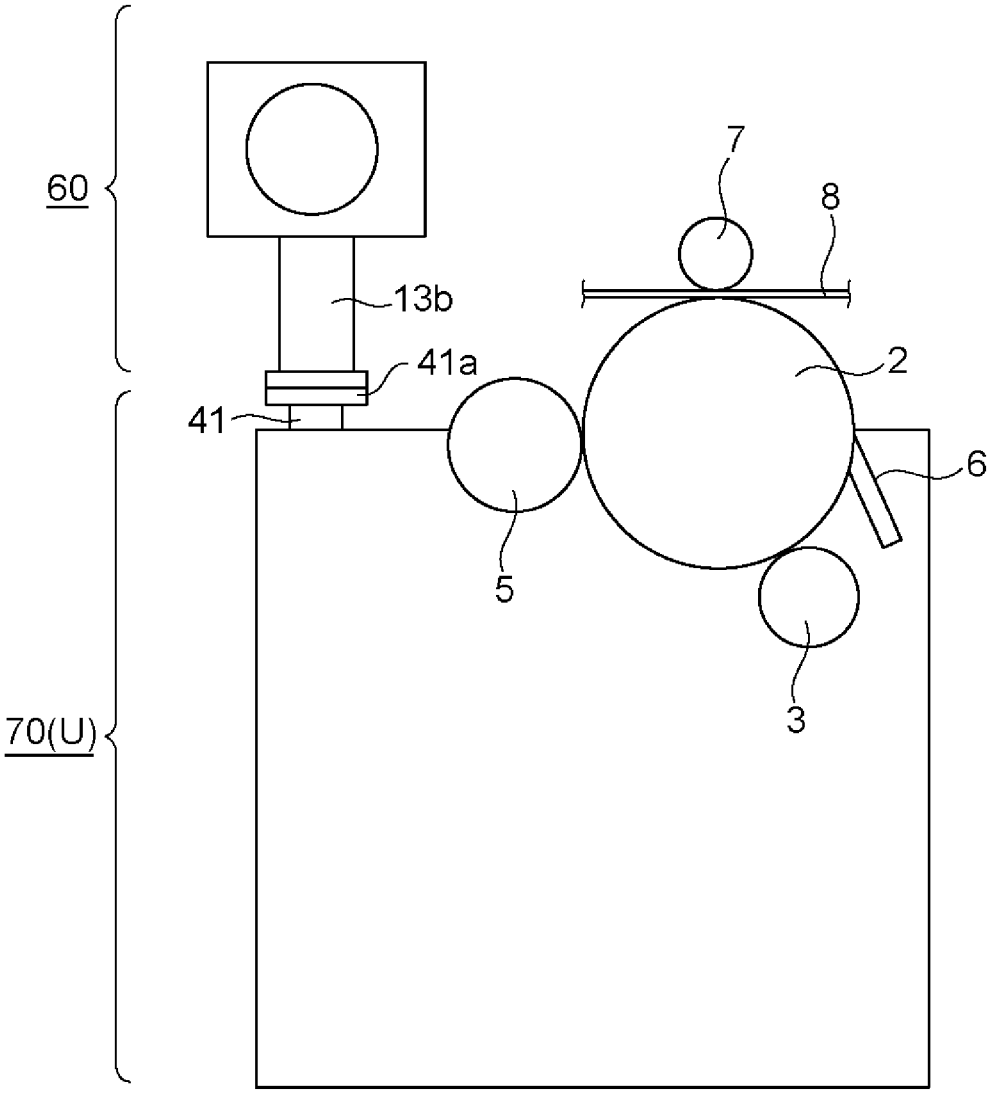

FIG. 18 is a schematic view of the device according to an Embodiment 3.

Figure 19:
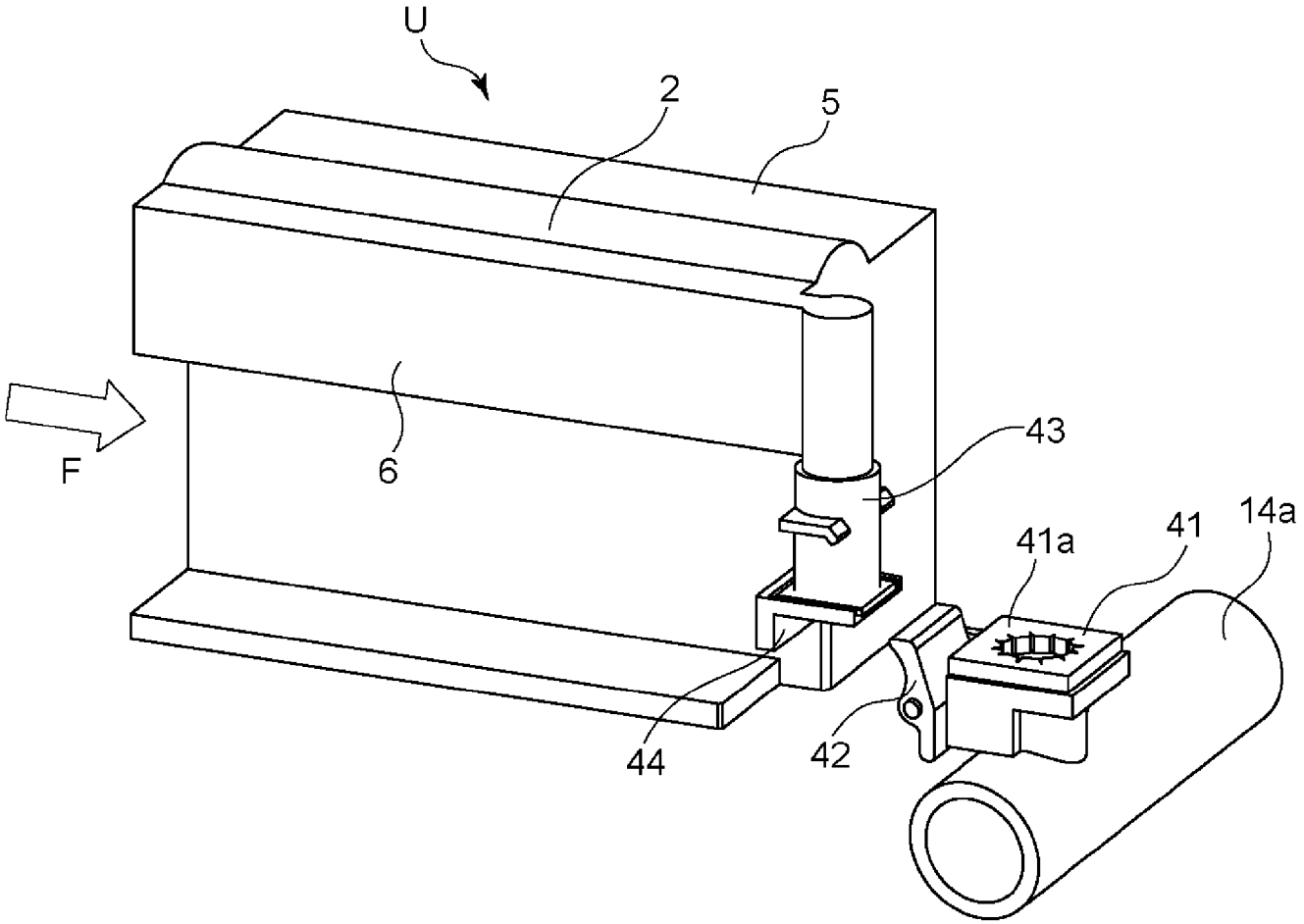

FIG. 19 is a perspective view of a neighborhood of a relaying portion in the process of the process cartridge being mounted to the main assembly, in Embodiment 4.

Figure 20:
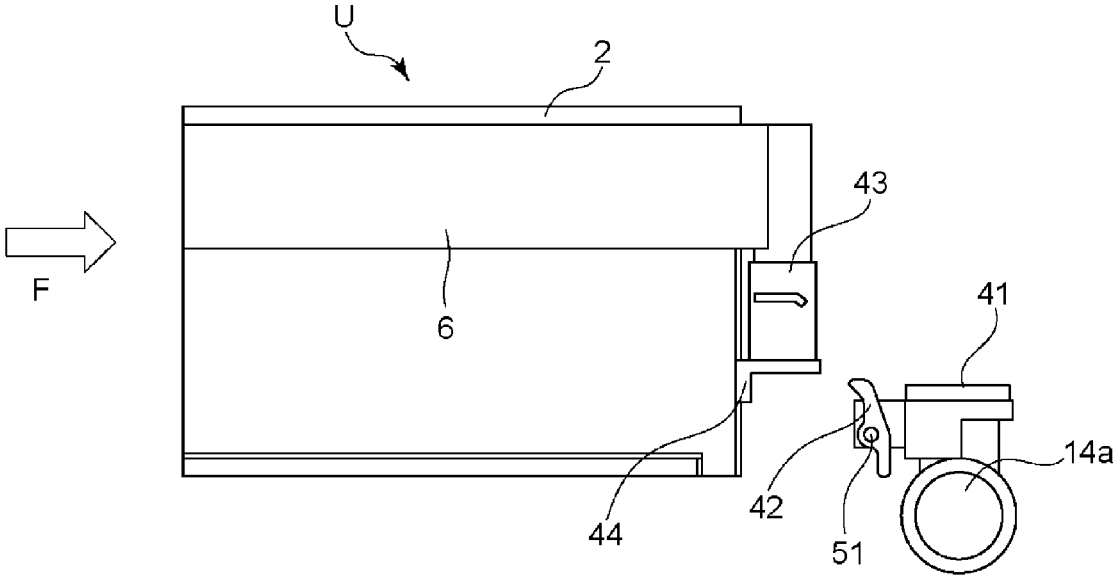

FIG. 20 shows the state before the operation of the shutter in Embodiment 4.

Figure 21:
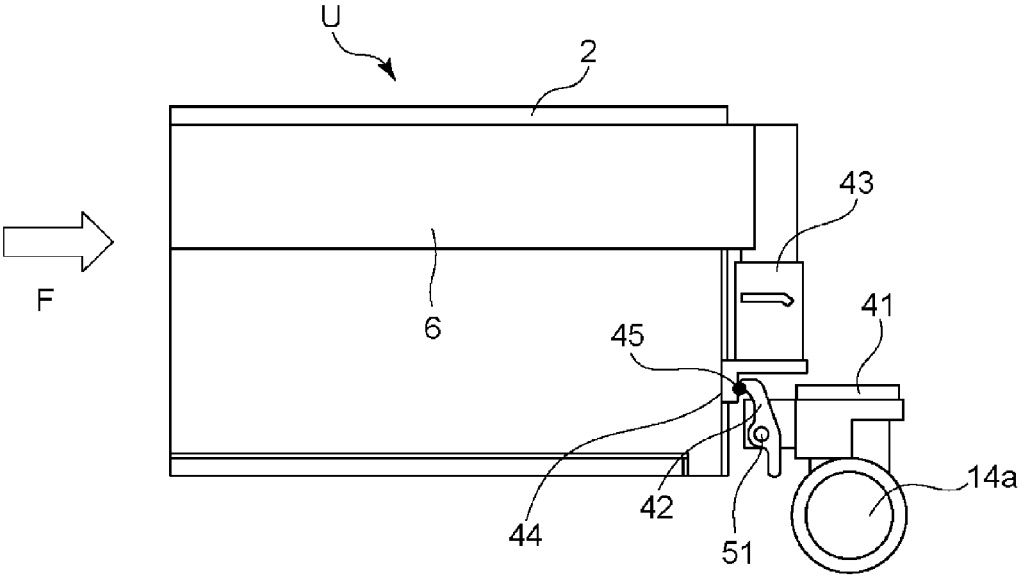

FIG. 21 shows the state in which the shutter starts contacting the shutter opening member in Embodiment 4.

Figure 22:
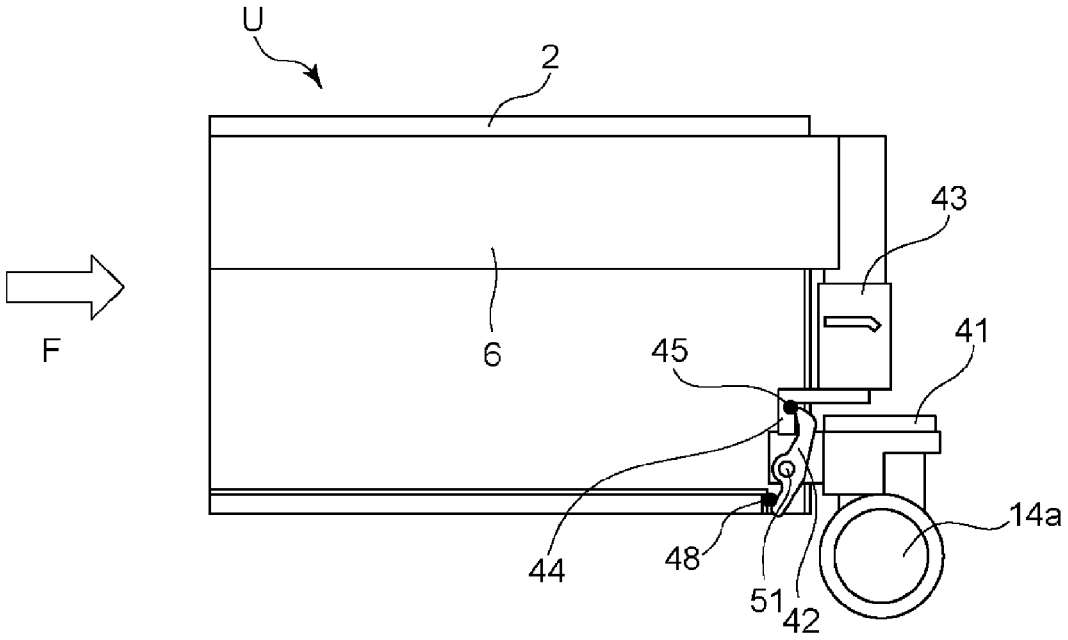

FIG. 22 shows the state in which the shutter opening member rotates to open the shutter.

Figure 23:
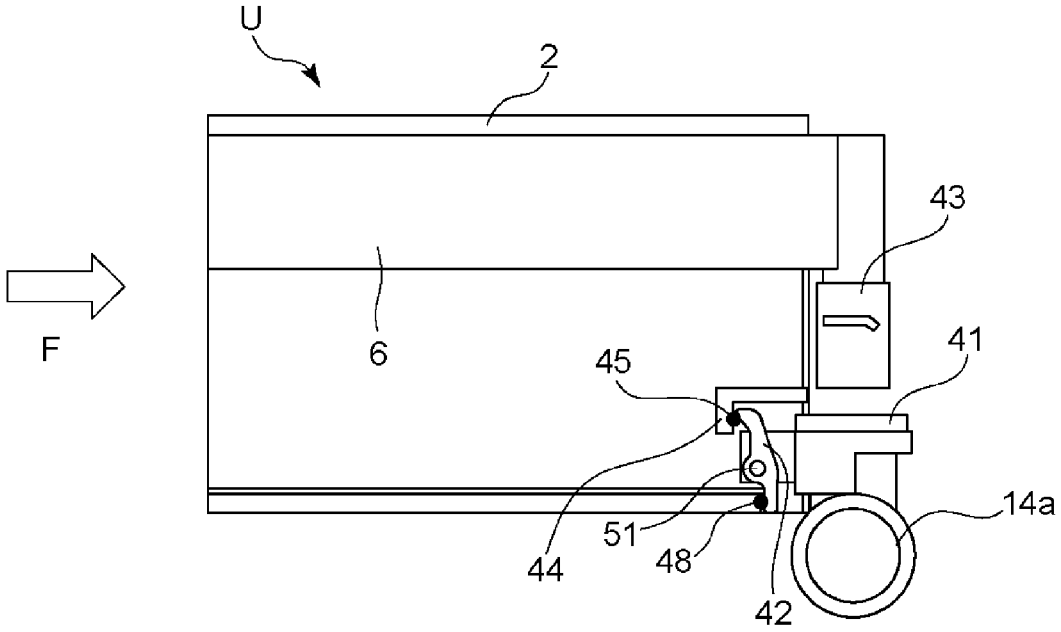

FIG. 23 shows the state in which the process cartridge is completely set in the main assembly of the apparatus in Embodiments 4.

DESCRIPTION OF THE EMBODIMENTS

Referring to the accompanying drawings, embodiments of the present invention will be described, taking an electrophotographic type printer which is an example of the image forming apparatus according to the present invention. The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated.

Embodiment 1

[Image Forming Station]

Figure 2:
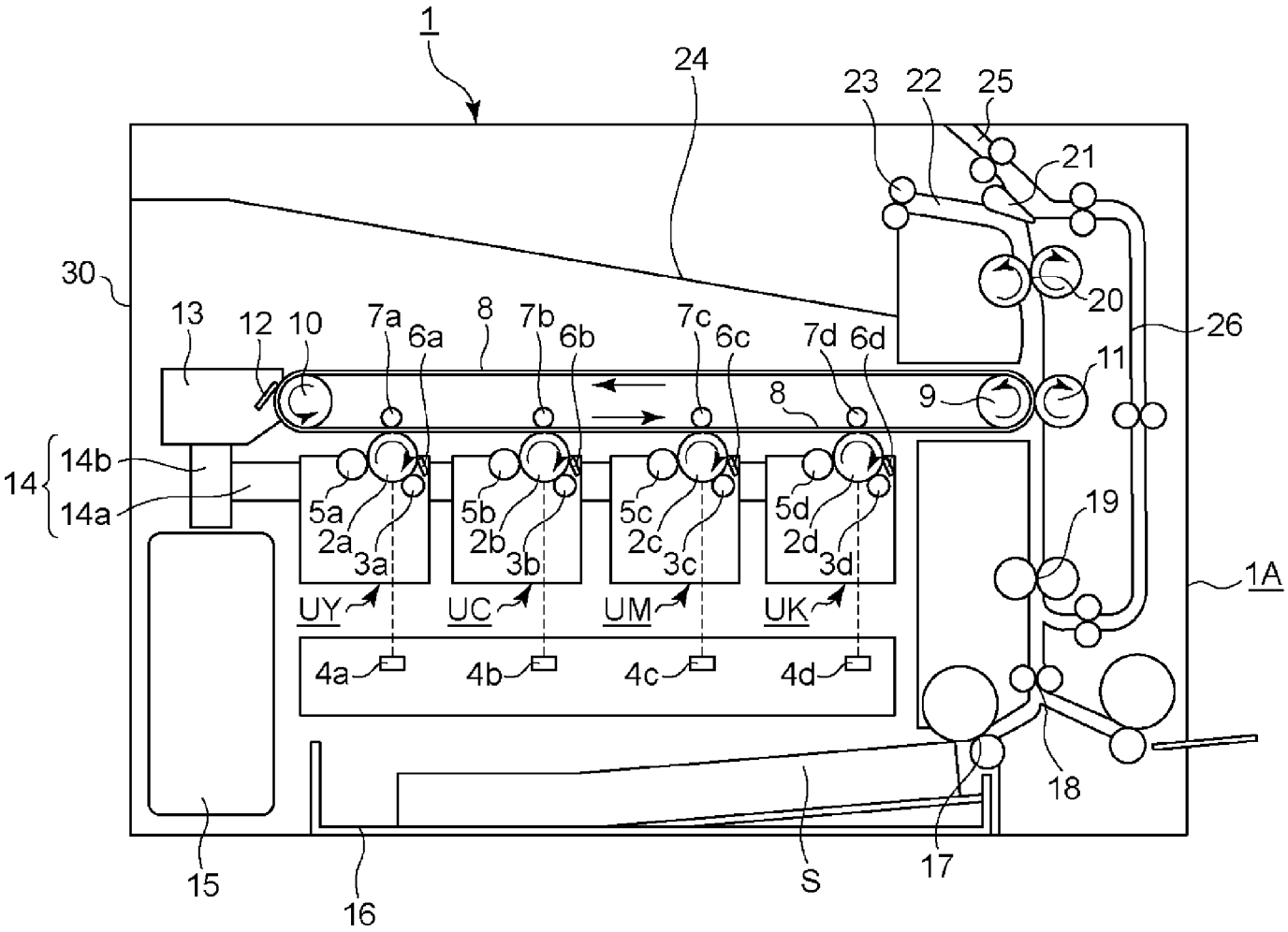
FIG. 2 is a sectional view of the electrophotographic type printer as in the example of the image forming apparatus.

FIG. 17 is a perspective view of an outer appearance of the color electrophotographic type printer as an example of the image forming apparatus 1. Part (a) of this Figure shows the state in which a front door 27 is closed relative to the main assembly of the image forming apparatus (main assembly) 1A, and part (b) shows the state in which the front door 27 is opened, and a process cartridge U is being inserted or removed. FIG. 2 is a longitudinal front view of the image forming apparatus 1.

Here, in the image forming apparatus 1 of the present embodiment, a front side is the side provided with the front door 27, and a rear side is in the side opposite from the front side. A frontward direction is a direction from the rear side toward the front side, and a backward direction is a direction from the front side toward the rear side. Left and right is the left-hand or right-hand as seen from the front side of the image forming apparatus 1. Upper and lower is based on the direction of gravity, that is, the vertical direction.

A sheet S is a sheet-like recording material on which the toner image is formed. The sheet S is not limited to a sheet of paper, and may be a sheet of a material other than the paper, such as resin material or compound material.

Referring mainly to FIG. 2, the main assembly 1A comprises four drum-like image bearing members, that is, photosensitive drums 2 (2*a*, 2*b*, 2*c*, 2*d*) (drums) arranged substantially horizontally with the drum axes extending in the front and rear direction from the left side to the right side. The drum 2 is rotated in the clockwise direction as indicated by an arrow by unshown driving means.

The image forming apparatus 1 also comprises a charging device 3 (3*a*, 3*b*, 3*c*, 3*d*) for uniformly charging the surface of the drum 2, and a scanner unit 4 (4*a*, 4*b*, 4*c*, 4*d*) for projecting a laser beam in accordance with image information to form an electrostatic latent image on the drum 2. The image forming apparatus 1 also comprises a developing device 5 (5*a*, 5*b*, 5*c*, 5*d*) for depositing toner of a developer onto the electrostatic latent image to develop it into a toner image, and a drum cleaning device 6 (6*a*, 6*b*, 6*c*, 6*d*) for removing untransferred toner remaining on the surface of the drum 2 after image transfer.

In the image forming apparatus of this embodiment, the drum 2, the charging device 3, the developing device 5 and the cleaning device 6 are contained in each of four process cartridges U (UY, UC, UM, UK). By these process cartridges U (image forming stations), different color (yellow (Y), cyan (C), magenta (M), black (K)) are formed on the respective drums 2 through an electrophotographic recording type process.

Primary transfer rollers 7 (7*a*, 7*b*, 7*c*, 7*d*) as transferring means are contacted to the intermediary transfer belt (belt) 8 to press the intermediary transfer belt to the drum 2 to transfer the toner image from the drum 2 onto the intermediary transfer belt 8. The belt 8 is extended around a driving roller 9 and a tension roller 10 and is driven by the driving roller 9 to rotate in the counterclockwise direction as indicated by the arrow. A secondary transfer roller 11 is provided opposed to the driving roller 9 through the belt 8 and functions to transfer the toner image already transferred onto the belt 8 onto the sheet S.

At the position opposed to the tension roller 10 through the belt 8, there are provided a cleaning blade 12 as a belt cleaning device and a toner feeding mechanism 13 in a belt unit to remove the untransferred toner remaining on the surface of the belt 8 and collect it. The collected untransferred toner is fed into a toner collection container 15 by the toner feeding mechanism 14.

As means for feeding the sheet S, there are provided a sheet feeding cassette 16 at the bottom of the inside of the main assembly, and a pair of registration rollers for correcting oblique feeding of the sheet S. Also provided are a fixing means 20 for fixing the toner image on the sheet S, a feeding path switching means 21 which is a flapper for feeding the sheet S to the discharging feeding path 22 in the case of one surface printing, and a pair of sheet discharging rollers 23 for discharging the sheet S onto the sheet discharge tray 24 which is a sheet stacking means.

The operation of the image forming apparatus will be described. The sheet S stacked on the sheet feeding cassette 16 is singled out by a feeding roller 17 and fed to the feeding roller 18 and to the registration roller pair 19 and then into the contact portion between the belt 8 and the secondary transfer roller 11. The toner images transferred onto the belt 8 in the image forming stations are transferred onto the sheet S by the functions of the belt 8 in the secondary transfer roller 11, so that a color image is formed on the sheet S, which is then fed into the fixing means 20.

In the fixing means 20, heat and pressure are applied to the toner image on the sheet S. The sheet S now having the fixed multi-color toner image is guided by the flapper 21 into a discharging feeding path 22 and is discharged onto the sheet discharge tray 24 by the sheet discharging roller pair 23.

In the case of the both-side-printing, the sheet S having the fixed image on one side thereof and discharged from the fixing means 20 is introduced into the switchback feeding path 25 by the flapper 21. The sheet is reversibly fed into a re-circulation feeding path 26 and then fed to the registration roller pair 19 again, in the reverse state in the facing orientation. Thereafter, the sheet is fed in the same manner as in the one surface printing operation, and a both-side-printed sheet S is discharged onto the sheet discharge tray 24.

[Exchange of Process Cartridge]

In this embodiment, the process cartridges (cartridges) U are exchanged through an opening provided by opening the front door on the front side of the main assembly 1A, as shown in part (b) of FIG. 17 (front access). The front side frame of the main assembly 1A is provided with the opening 28 for permitting the cartridges to pass into the main assembly, for mounting and demounting of the cartridges U. More particularly, the opening 28 is used when the cartridge U is inserted to the cartridge mounting portion (unshown) of the main assembly 1A and when the cartridge U is removed from the cartridge mounting portion.

The front door 27 is movable between a close position C for closing the opening 28 and an open position D for opening of the opening 27. When the front door 27 is opened, the cartridges U in the main assembly 1A are moved to the positions for the mounting and dismounting of the cartridges U relative to the main assembly 1A, by an operation mechanism (unshown) interrelated with the opening operation of the front door 27.

Then, the cartridge U to be removed is slid out of the main assembly 1A along the guiding rail in the cartridge mounting portion in the direction indicated by a arrow E (toward the front side). Subsequently, a fresh cartridge U is inserted into the main assembly 1A through the opening 27 with the trailing edge side (driving side) in the leading side, and is engaged with the guiding rail of the cartridge mounting portion, and then is pushed sufficiently toward the rear side as indicated by a arrow F.

After all of the cartridges U to be replaced are set in the main assembly, the front door 27 is closed. By the operation mechanism interrelated with the closing operation of the front door 27, the cartridges U in the main assembly are moved from the position where the cartridge is mountable and dismountable relative to the main assembly 1A to a position where an image forming operation is possible. The cartridges are positioned and maintained in place. In this state, the image forming apparatus 1 is capable of performing the image forming operation (FIG. 2).

The sheet feeding cassette 16 can be drawn out toward the front side indicated by the arrow E from the main assembly 1A (front access), and the sheets S can be supplied. The drawn out sheet feeding cassette 16 can be inserted in the direction indicated by the arrow F (toward the rear side) into the main assembly 1A.

[Collection of Untransferred Toner and Exchange of Toner Collection Container]

Referring to FIG. 3, the description will be made as to a collection method for collecting the untransferred toner remaining on the drum 2 and the belt 8 into a toner collection container (remaining toner collecting unit) 15 for storing the residual toner from the image forming station, and as to an exchanging method for the toner collection container 15. FIG. 3 shows the state in which the toner collection container 15 is exchanged, in which a part (a) shows the state in which the toner collection container 15 is mounted to the main assembly, and part (b) shows the state in which the toner collection container 15 is exchanged.

The toner feeding mechanism 14 is fixed in the main assembly 1A and comprises a drum side toner feeding mechanism 14*a* and a belt side toner feeding mechanism 14*b*. Designated by 30 is a left-hand door provided for permitting change of the toner collection container 15. Designated by 31 is a circular column configuration hinge which is provided at each of upper and lower portions of the left-hand door and which has a rotational center axis A. The toner collection container 15 is disposed in a space closed by the left-hand door 30, and when the left-hand door 30 is opened, the toner collection container 15 is exposed by the rotating operation of the left-hand door 30. The left-hand door 30 is normally closed.

The drum side toner feeding mechanism 14*a* extends in the rear side over the length of the arrangement of the cartridges U in the left-right direction in the main assembly 1A. The toner remaining on the surfaces of the drums 2 of the cartridges during the image forming operation of the image forming apparatus 1 is scraped off by the cleaning blades of the cleaning devices 6 and falls into the cleaner containers. The toner in the cleaner container is fed toward the rear side in the cleaner container and is discharged into the drum side toner feeding mechanism 14*a*. The toner discharged into the drum side toner feeding mechanism 14*a* is fed toward the left side.

On the other hand, the untransferred toner remaining on the belt 8 is scraped off by the cleaning blade 12. The scraped toner is fed toward the rear side by the in-belt toner feeding mechanism 13 and is discharged into the belt side toner feeding mechanism 14*b* and is merged with the toner fed by the drum side toner feeding mechanism 14*a*. The belt side toner feeding mechanism 14*b* is disposed above the toner collection container 15 so that the merged toner falls into the toner collection container 15, by which the toner is accumulated in the toner collection container 15.

The exchanging method of the toner collection container 15 will be described. When a sensor (unshown) detects a toner full state of the toner collection container 15 as a result of the accumulation of the toner, a controller (unshown) produces a display prompting the user to exchange the toner collection container 15, and the display portion (unshown).

As shown in part (b) of FIG. 3, the user opens the left-hand door 30 in a direction indicated by an arrow R along the axis A of the upper and lower hinges 31. After the opening the left door 30, the toner collection container 15 is slid out of the main assembly 1A in the direction indicated by an arrow B2. When the toner collection container 15 is to be inserted, it is slid in the direction indicated by an arrow B1 on the inside of the left-hand door 30, and then the left-hand door 30 is closed into the state shown in part (a) of FIG. 3.

[Toner Scattering Prevention Structure]

Figure 1:
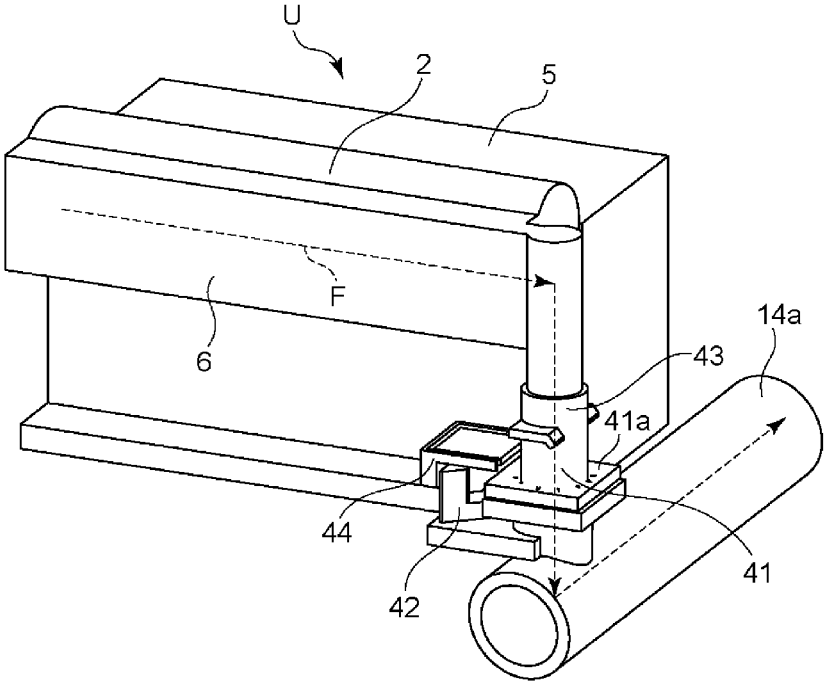
FIG. 1 is a perspective view of a neighborhood of a relaying portion when the image forming operation is carried out with the process cartridge mounted in place, according to Embodiment 1 of the present invention.

Referring to FIGS. 1 and 4, the description will be made as to the structure of the shutter for opening and closing the untransferred toner discharge opening of the cartridge U and as to the mechanism for opening the shutter.

FIG. 1 is a perspective view showing a neighborhood of a toner relaying portion from one of the cartridges U into the drum side toner feeding mechanism 14*a*. FIG. 4 shows a neighborhood of a toner relaying portion from one of the cartridges U into the drum side toner feeding mechanism 14*a*, when the cartridge U is being mounted to the main assembly 1A. The same applies to the other cartridges U.

In this embodiment, the cartridge U includes the toner discharge opening 43 and is a first unit detachably mountable to the main assembly 1A. The drum side toner feeding mechanism 14*a* is provided with the toner receiving opening (connecting portion) 41 and is a second unit stationarily provided in the main assembly 1A. In the state that the cartridge U is mounted in place in the main assembly 1A, the toner discharge opening 43 of the cartridge U is above the toner receiving opening 41 of the drum side toner feeding mechanism 14*a*, so that the toner moves from the cartridge U into the driving side toner feeding mechanism 14*a*.

The toner discharge opening 43 and the toner receiving opening 41 have substantially the same opening shapes and the areas. The size of the opening of the toner discharge opening 43 may be made smaller than that of the opening of the toner receiving opening 41. Designated by 14*a* is an elastic member for sealing the toner receiving opening 41 and which extends around the opening of the toner receiving opening 41. In the state in which the toner discharge opening 43 and the toner receiving opening 41 are connected with each other, the sealing member 14*a* is between the toner discharge opening 43 and the toner receiving opening 41 to close the gap between them.

That is, the untransferred toner scraped off the drum 2 into the cleaner container by the cleaning blade of the cleaning device 6 during the image forming operation of the image forming apparatus 1 is fed toward the rear side as indicated by an arrow F in the cleaner container of the cleaning device 6, as indicated by the broken line with an arrow in FIG. 1. The untransferred toner falls into side drum side toner feeding mechanism 14*a* through the relaying portions 43•41 between the cartridges U and the drum side toner feeding mechanism 14*a*.

In the cleaner container of the cleaning device 6 and in the drum side toner feeding mechanism 14*a*, there are provided toner feeding screws (unshown), respectively, and by the rotations of the screws, the toner is fed. The toner fed toward the rear side in the cleaner container is introduced into the pipe 43 which is a downward toner discharge opening of the cartridge U and falls, and then enters the drum side toner feeding mechanism 14*a* through the toner receiving opening 41 of the drum side toner feeding mechanism 14*a*.

The cartridge U is provided with a toner shutter 44 to prevent the leakage of the toner through the toner discharge opening 43 when the cartridge U is being pulled out of the main assembly 1A. The shutter 44 is slidable in the front and rear direction E-F relative to the cartridge U and is normally urged toward the rear side F, that is, in the inserting direction of the cartridge U into the main assembly 1A. By this, in the state that the cartridge U is not in the main assembly, the shutter 44 is in the position sufficiently close to the toner discharge opening 43, so that the toner leakage through the toner discharge opening 43 is prevented.

In the insertion process of the cartridge U to the predetermined rear side position of the main assembly 1A, the shutter 44 is opened by a shutter opening member 42 provided in the main assembly 1A. FIG. 5 through FIG. 11 illustrate the opening operation of the shutter 44. The operation will be described.

FIG. 5 illustrates the state before the shutter is opened. FIG. 6 illustrates the state in which the shutter 44 starts to contact the shutter opening member 42. FIG. 7 illustrates the state in which the shutter opening member 42 contacts the rotation abutting portion 46. FIG. 8 illustrates the state in which the cartridge U starts to contact the shutter opening member 42 and the contact surface 47. FIG. 9 illustrates the state in which the cartridge U is rotating the shutter opening member 42 so that the shutter is being opened. FIG. 10 illustrates the state in which the surface where the cartridge U presses the shutter opening member 42 shifts from the contact surface 47 to the contact surface 48. FIG. 11 illustrates the state in which the cartridge is inserted into the predetermined rear end of the main assembly.

1) In the state shown in FIG. 5, the cartridge U is inserted into the main assembly, and the training side of the cartridge reaches the neighborhood of the drum side toner feeding mechanism 14*a*. At this time, the shutter 44 is still in the free state, and therefore, it closes the toner discharge opening 43 of the cartridge U by the urging force of the spring.

When the cartridge U is further inserted, the shutter 44 is brought into contact to the shutter opening member 42 at the contact surface 45, as shown in FIG. 6. When the cartridge U is further inserted, the shutter opening member 42 is rotated about the rotation axis 51 of the shutter opening member 42 by the force applied at the contact surface 45. The shutter opening member 42 is rotatable so as to be rotated substantially without load. This is because the shutter 44 is urged in the inserting direction F of the cartridge U by the spring (unshown) described above, by which the force required to rotate the shutter opening member 42 is smaller than the force required to open the shutter 44.

2) When the cartridge U is further inserted, the shutter opening member 42 is stopped by the abutting portion 46. Even if the initial position of the shutter opening member 42 is slightly deviated by the rotation from the position indicated in FIG. 6, or is in the state contacting to the abutting portion 46, the shutter opening member 42 is pressed by the shutter 44 so that it is in contact with the abutting portion 46 irrespective of the initial position. By this, it is unnecessary to determine the initial position where the shutter opening member 42 is in the stand-by state, at the time when the cartridge U is absent.

3) When the cartridge is further inserted, the cartridge U starts to contact to the shutter opening member 42 at the contact surface 47.

4) When the cartridge U is further inserted, the shutter opening member 42 is rotated by the contact surface 47 with the cartridge U, as shown in FIG. 9. By this, the shutter 44 is pressed back by the contact surface 45 with the shutter opening member 42.

5) When the cartridge U is further inserted, the contact surface contacting the cartridge U shifts from the contact surface 47 to the contact surface 48.

6) When the cartridge U is further inserted to the extent that the cartridge U reaches the predetermined rear side position of the main assembly 1A, the state is as shown in FIG. 11.

At this time, the cartridge U receives a reaction force in the direction E opposed to the inserting direction F from the shutter opening member 42. By this, no force tending to incline the cartridge U in the left and right direction is produced, thus preventing the deviation of the position of the cartridge U. The shutter opening member 42 always receives the force in the direction of closing the shutter 44. Therefore, by making the contact surface 48 and the contact surface 45 close to the rotation axis 51 of the shutter opening member 42, the creep deformation of the shutter opening member 42 can be reduced.

7) After the insertion of the cartridge U into the main assembly 1A, the front door 27 is closed. In interrelation with the closing operation of the front door 27, the pipe 43 which is the toner discharge opening slides to the toner receiving opening (connecting portion) 41 of the drum side toner feeding mechanism 14*a* to close a gap 49 between the toner discharge opening 43 and the toner receiving opening 41, by a mechanism (unshown).

The mechanism for closing the gap 49 may be a mechanism by which at least one of the toner discharge opening 43 and the toner receiving opening 41 is moved in the direction of engagement therebetween to close the gap 49 therebetween. In addition, the mechanism may be a structure by which at least one of the toner discharge opening 43 and the toner receiving opening 41 is moved in the direction of disengagement which is the opposite to the direction of engagement, in interrelation with the operation opening the front door 27.

The operations 1) to 7) will be described as to the cartridge U side toner discharge opening 43, the drum side toner feeding mechanism 14*a*, the toner receiving opening 41, and the shutter 44 in terms of toner leakage prevention.

As shown in FIGS. 4 and 5, the shutter 44 is inserted into the main assembly 1A integrally with the cartridge U at the initial stage, and in the shown state, the toner discharge opening 43 is sufficiently closed by the shutter 44.

When the shutter opening member 42 abuts the abutment surface 46, as shown in FIG. 7, the relative position between the cartridge U and the shutter 44 starts to change by the same amount of the movement of the cartridge U. At this time, the shutter 44 overlaps a toner receiving opening 41 or a predetermined part right above the sealing member 41*a* for preventing toner leakage. By this, when the toner discharge opening 43 of the cartridge U starts to open, the toner receiving opening 41 of the drum side toner feeding mechanism 14*a* receives it.

Here, the predetermined part is at least the part from the position where the shutter 44 and the toner receiving opening 41 or the sealing member 41*a* start to overlap to the position where the toner receiving opening 41 covered by the shutter 44 and the toner discharge opening 43 start to overlap.

As shown in FIGS. 8, 9 and 10, the shutter opening member 42 is rotated by the cartridge U, by which the relative position between the cartridge U and the shutter 44 starts to change by the same movement distance of the cartridge plus the distance caused by the rotation of the shutter opening member 42. That is, after the shutter 44 reaches at least the position right above the predetermined position of the toner receiving opening 41 or the seal member 41*a* for the toner receiving opening 41, the shutter 44 is opened by the further insertion of the cartridge U.

In this embodiment, in the process of the shutter 44 being open by the insertion of the cartridge U, the movement amount of the opening shutter 44 is larger than the amount of insertion of the cartridge U into the main assembly 1A.

As shown in FIGS. 8 and 9, the opening movement amount of the shutter relative to the cartridge insertion amount at the time when the shutter 44 is opened by the shutter opening member 42 rotated by the contact surface 47 is Z1. As shown in FIGS. 10 and 11, the opening movement amount of the shutter relative to the cartridge insertion amount at the time when the shutter 44 is opened by the shutter opening member 42 rotated by the contact surface 48 is Z2. The contact surface 48 is closer to the rotation axis 51 of the shutter opening member 42 than the contact surface 47. For this reason, Z2>Z1.

By opening the shutter 44 in this manner, a gap 50 is provided between the toner discharge opening 43 and the shutter 44 when the cartridge U shown in FIG. 11 is inserted to the predetermined rear side position of the main assembly 1A. Therefore, when the toner discharge opening 43 slides on the opening 28 side of the main assembly 1A, the shutter 44 does not interfere. When the cartridge U is inserted to the predetermined rear side of the main assembly 1A, no further insertion is prevented by the rear side positioning portion (unshown).

In the state that the cartridge U is in the predetermined rear side position of the main assembly 1A, the shutter 44 is in the open position where the toner discharge opening 43 is sufficiently opened. And, the opened toner discharge opening 43 is above the toner receiving opening 41 (FIG. 11).

After the insertion of the cartridge U into the main assembly 1A, the front door 27 is closed. In interrelation with the closing operation of the front door 27, the toner discharge opening 43 slides to the toner receiving opening 41 side, so that the gap 49 relative to the toner receiving opening 41 is closed.

In addition, in this embodiment, the shutter opening member 42 is once contacted to the abutting portion 46, by which the rotation thereof is stopped, but the rotation may be stopped by the contact surface 47 of the cartridge U. The contact surface relative to the cartridge U is shifted from the contact surface 47 to the contact surface 48, but the contact surface 48 is used from the beginning. In this embodiment, the toner relaying connecting portion 43-41 is the vertical, but may be slanted corresponding to the slanted arrangement of the photosensitive drums.

The operation of closing the shaft 44 for the purpose of removing the cartridge U from the main assembly 1A is the opposite from the above-described operation of inserting the cartridge U into the main assembly 1A.

With the structures of this embodiment, when the cartridge U is exchanged, the toner scattering prevention can be accomplished without special operation by the user, and therefore, the usability is improved.

Embodiment 2

Referring to FIG. 3, FIG. 12 through FIG. 16, a second embodiment of the present invention will be described. The image forming apparatus 1 of this Embodiment 2 comprises a toner feeding mechanism 14*a* and a toner collection container 15. The other structures of the same as those of Embodiment 1, and in the description of this embodiment, the same reference numerals as in Embodiment are assigned to the elements having the corresponding functions in this embodiment, and the detailed description thereof is omitted for simplicity.

In this Embodiment 2, the toner feeding mechanism 14*a* is a first unit provided with a toner discharge opening 13*b* and provided stationarily in the main assembly 1A. The toner collection container (remaining toner collecting unit) 15 is provided with a toner receiving opening 41 and is detachably mountable to the main assembly 1A. In the state that the toner collection container 15 is set in the main assembly 1A, the toner discharge opening 13*b* of the toner feeding mechanism 14*a* is above the toner receiving opening 41 of the toner collection container 15, so that the toner moves from the toner feeding mechanism 14*a* into the toner collection container 15.

FIG. 3 illustrates the state in which the toner collection container 15 is being exchanged, wherein part (a) shows the state of the toner collection container 15 set in the main assembly 1A, and part (b) shows the toner collection container 15 being exchanged. FIG. 12 is a perspective view of the neighborhood of the toner feeding mechanism 14*a* and the toner relaying portion of the toner collection container 15. FIG. 13 is a perspective view of the neighborhood of the toner relaying portion when the toner collection container 15 is being mounted to the main assembly 1A.

The untransferred toner is fed into the toner collection container 15 as indicated by broken line arrows. As shown in FIG. 3, when the left-hand door 30 is opened in order to exchange it toner collection container 15, the toner collection container 15 is moved to the outside of the main assembly 1A, integrally with the door 30. In the state that the door 30 is open, the toner collection container 15 is detachably mountable in the directions of arrows B1·B2 in part (b) of FIG. 3. The arrow B1 depicts the inserting direction, and the arrow B2 depicts the removing direction.

The toner discharge opening 13*b* is provided with a shutter 44 to prevent leakage of the toner through the toner discharge opening 13*b* of the toner feeding mechanism 14*a* when the toner collection container 15 is outside the main assembly 1A.

The shutter 44 is slidable in the inserting direction B1 of the toner collection container 15 and is urged by a spring (unshown) in the direction opposite from the inserting direction B1. By doing so, in the state that the toner collection container 15 is outside of the main assembly 1A, the shutter 44 closes the toner discharge opening 13*b*.

FIG. 14 shows the state before the operation of the shutter 44. FIG. 15 shows the state in which the shutter opening member 42 is being rotated by the abutting portion 46 of the main assembly 1A, by which the shutter 44 is being opened. FIG. 16 shows the state in which the toner collection container 15 is set in the main assembly 1A, and the door 30 is being closed.

As shown in FIG. 14, the toner discharge opening 13*b* is sufficiently closed by the shutter 44. Then, as shown in FIG. 15, the shutter 44 starts to open when the shutter opening member 42 contacts the contact surface 45 and the contact surface 48.

When the toner collection container 15 is inserted to the predetermined rear side, and the left-hand door 30 is closed, the shutter opening member 42 opens the shutter 44. In addition, a mechanism (unshown) is provided such that in interrelation with the closing operation of the left-hand door, the toner discharge opening 13*b* slides to the toner receiving opening (connecting portion) 41 of the toner collection container 15, and the gap between the toner discharge opening 13*b* and the toner is closed.

The operation of closing the shutter 44 with the removal of the toner collection container 15 is the opposite from the operation in inserting the toner collection container 15 described above.

With this structure of this embodiment, when the cartridge U is exchanged, the toner scattering prevention can be accomplished without special operation by the user, and therefore, the usability is improved.

Embodiment 3

Referring to FIG. 18, a third embodiment of the present invention will be described. The image forming apparatus 1 of this Embodiment 3 comprises a toner supply unit 60 and a developing device 5 of an image forming station 70 or process cartridge U. The other structures of the same as those of Embodiment 1, and in the description of this embodiment, the same reference numerals as in Embodiment 1 are assigned to the elements having the corresponding functions in this embodiment, and the detailed description thereof is omitted for simplicity.

In this Embodiment 3, the toner supply unit 60 is a first unit detachably mountable to the main assembly 1A and provided with a toner discharge opening 13*b*. The developing device 5 of the image forming station 70 or the process cartridge U is a second unit which is provided with a toner receiving opening 41 and which is fixed or detachably mountable relative to the main assembly 1A.

In the state that the toner supply unit 60 is set in the main assembly 1A, the toner discharge opening 13*b* of the toner supply unit 60 is above the toner receiving opening 41 of the developing device 5 or the process cartridge U. From the toner supply unit 60, a proper amount of the supply toner is supplied into the developing device 5 of the image forming station 70 or the developing device 5 of the process cartridge U.

Although not shown in FIG. 18, the structures and operations of the toner scattering preventing mechanism using the toner discharge opening 13*b*, the shutter 44, the toner, the shutter opening member 42 and so on are the same as those of Embodiment 1.

Embodiment 4

Referring to FIG. 19 through FIG. 23, a fourth embodiment will be described. In Embodiment 1 described hereinbefore, the rotational axis of the shutter opening member extends in the vertical direction, and the shutter opening member rotates in the left-right direction, but in this Embodiment 4, the rotational axis of the shutter opening member extends in the horizontal direction, and the shutter opening member rotates in the vertical direction. The other structures of the same as those of Embodiment 1, and in the description of this embodiment, the same reference numerals as in Embodiment 1 are assigned to the elements having the corresponding functions in this embodiment, and the detailed description thereof is omitted for simplicity.

FIG. 19 is a perspective view illustrating the state in which the cartridge U is being mounted. FIG. 20 illustrates the state before the shutter is opened. FIG. 21 illustrates the state in which the shutter 44 starts to contact the shutter opening member 42. FIG. 22 illustrates the state in which the cartridge U is rotating the shutter opening member 42 so that the shutter is being opened. FIG. 23 shows the state that the cartridge U has been inserted to the predetermined rear side position of the main assembly.

When the cartridge U is inserted into the main assembly, the shutter opening member 42 is contacted by the shutter 44 at the contact surface 45. When the cartridge U is further inserted, the shutter opening member 42 is rotated about the rotation axis 51 of the shutter opening member 42 by the force applied at the contact surface 45. Similarly to the foregoing description, because the shutter 44 is urged in the inserting direction F of the cartridge U by the spring (unshown) described above, by which the force required to rotate the shutter opening member 42 is smaller than the force required to open the shutter 44, the shutter opening member 42 rotates without opening the shutter 44.

When the cartridge U is further inserted, the cartridge U contacts the shutter opening member 42 at the contact surface 48, and by a further insertion of the cartridge U, the shutter opening member 42 is rotated by the contact surface 48. By this, the shutter 44 is pressed back by the contact surface 45 with the shutter opening member 42.

When the cartridge U is further inserted to the extent that the cartridge U reaches the predetermined rear side position of the main assembly 1A, the state is as shown in FIG. 22.

With the structures of this embodiment, when the cartridge U is exchanged, the toner scattering prevention can be accomplished without special operation by the user, and therefore, the usability is improved.

Embodiment 5

Embodiment 5 will be described. In Embodiment 1, as shown in FIG. 2, the intermediary transfer belt 8, the driving roller 9, the tension roller 10, the primary transfer roller 7, the cleaning blade 12, the in-belt toner feeding mechanism 13, the belt side toner feeding mechanism 14*b* are all provided in the image forming apparatus 1. In Embodiment 5, the intermediary transfer belt 8, the driving roller 9, the tension roller 10, the primary transfer roller 7, the cleaning blade 12, the in-belt toner feeding mechanism 13 and the belt side toner feeding mechanism 14*b* are all included in a transfer belt unit 80. By doing so, the transfer belt unit 80 can be detachably mounted to the main assembly 1A.

That is, in this case, the transfer belt unit 80 is a first unit provided with the toner discharge opening 14*b*, and the toner collection container (remaining toner collecting unit) 15 is a second unit provided with the receiving opening 41 and detachably mountable to the main assembly 1A. In this case, the toner scattering preventing mechanism between the first and second units may be the same as that of Embodiment 1 between the process cartridge U and the drum side toner feeding mechanism 14*a*.

Others

1) The unit detachably mountable to the main assembly 1A of the image forming apparatus 1 is not limited to a so-called integral type process cartridge U including at least the drum (image bearing member) 1 and the developing device 5 for developing the latent image on the drum. The process cartridge U may be a so-called separable type process cartridge including at least a drum 1, and an image forming process means other than the developing device 5.

It may be a developing unit (developing cartridge) including a developing means for developing the latent image formed on the drum 1 with toner. It may be a cleaning unit provided with a cleaning means for removing the developer from the drum 1.

2) An image formation system of the image forming apparatus is not limited to the electrophotographic image formation type using the electrophotographic photosensitive member as the image bearing member in the foregoing embodiments. The image forming apparatus may be of an electrostatic recording image formation type using a dielectric member for electrostatic recording as the image bearing member, or a magnetic recording image formation system using a magnetic member for magnetic recording as the image bearing member. The image forming apparatus may be achromatic image forming apparatus. The transfer type is not limited to a particular one, but a direct transfer type in which the toner image is transferred directly onto the recording material 12 is usable. The image forming apparatus may be a color image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-037865 filed on Feb. 27, 2015 and 2016-009781 filed on Jan. 21, 2016, which are hereby incorporated by reference herein in their entirety.

What is claimed is:

1. An image forming apparatus for forming a toner image on a sheet, said image forming apparatus comprising:

a main assembly;

a first unit including a toner discharge opening;

a second unit including a toner receiving opening, wherein at least one of said first unit and said second unit is detachably mountable to said main assembly; and a shutter configured to permit toner to move from said first unit into said second unit in a state that the toner discharge opening of said first unit is above the toner receiving opening of said second unit when said at least one of said first unit and said second unit are set in said main assembly, and to close said toner discharge opening of said first unit when said at least one of said first unit and said second unit is removed from said main assembly, wherein said main assembly includes a shutter opening member configured to open said shutter, and wherein insertion of said at least one of said first unit and said second unit into said main assembly causes contact with said shutter opening member and rotates said shutter opening member such that said shutter is moved to a position above part of a sealing member for said toner receiving opening, and thereafter, said shutter is opened by a further insertion of said at least one of said first unit and said second unit into said main assembly.

2. An apparatus according to claim 1, wherein the part of said sealing member extends from a position where said shutter and said toner receiving opening or said sealing member start to overlap with each other by the insertion of said at least one of said first unit and said second unit into said main assembly to a position where said toner receiving opening and said toner discharge opening, in a state of being covered by said shutter, start to overlap with each other.

3. An apparatus according to claim 1, wherein an amount of opening of said shutter is larger than an amount of insertion of at least one of said first unit and second unit at a timing during the insertion.

4. An apparatus according to claim 1, wherein said shutter opening member is rotatable about a rotation axis, which crosses an insertion direction of said first unit or said second unit, in a state that said first unit or second unit is removed from said main assembly, and is provided with a first surface contactable to said shutter and a second surface contactable to said first unit or second unit, said first surface and said second surface being disposed across the rotation axis from each other.

5. An apparatus according to claim 1, wherein a contact surface of said shutter opening member relative to said first unit or said second unit shifts in a process of the insertion of said first unit or said second unit into said main assembly.

6. An apparatus according to claim 1, wherein said shutter is urged in a direction of closing said toner discharge opening of said first unit.

7. An apparatus according to claim 1, wherein said first unit is a process cartridge, a transfer belt unit or a toner supply unit detachably mountable to said main assembly.

8. An apparatus according to claim 1, wherein said second unit is a remaining toner collecting unit configured to store residual toner from an image forming station and detachably mountable to said main assembly.

9. An apparatus according to claim 1, further comprising a door openable for said first unit or second unit to enter into said main assembly, wherein at least one of said toner discharge opening and said toner receiving opening moves toward each other to close a gap between said toner discharge opening and said toner receiving opening in interrelation with a closing operation of said door.

10. An apparatus according to claim 1, wherein said first unit includes said shutter.

11. An apparatus according to claim 10, wherein said first unit includes an image bearing member on which an electrostatic latent image is formed.

* * * * *